US011396839B2

(12) United States Patent
Tanaka et al.

(10) Patent No.: US 11,396,839 B2
(45) Date of Patent: Jul. 26, 2022

(54) HYDRAULIC DRIVE FAN CONTROL DEVICE

(71) Applicant: Hitachi Construction Machinery Co., Ltd., Tokyo (JP)

(72) Inventors: Takaaki Tanaka, Ushiku (JP); Masatsugu Arai, Kasumigaura (JP); Takayuki Sato, Kashiwa (JP); Naoki Fukuda, Tsuchiura (JP); Jun Ikeda, Tsuchiura (JP); Ryuji Kouno, Mito (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 282 days.

(21) Appl. No.: 16/646,025

(22) PCT Filed: Sep. 21, 2018

(86) PCT No.: PCT/JP2018/035141

§ 371 (c)(1),
(2) Date: Mar. 10, 2020

(87) PCT Pub. No.: WO2020/059130

PCT Pub. Date: Mar. 26, 2020

(65) Prior Publication Data

US 2022/0056833 A1 Feb. 24, 2022

(51) Int. Cl.
*F01P 7/04* (2006.01)
*E02F 9/22* (2006.01)
(Continued)

(52) U.S. Cl.
CPC ..... *F01P 7/044* (2013.01); *E02F 9/22* (2013.01); *F01P 11/18* (2013.01); *F04D 27/004* (2013.01); *F01P 2037/00* (2013.01)

(58) Field of Classification Search
CPC ..... F01P 7/044; F01P 11/18; F01P 2037/00; E02F 9/22; F04D 27/004
See application file for complete search history.

(56) References Cited

U.S. PATENT DOCUMENTS

2005/0254959 A1 11/2005 Furuta et al.
2009/0101101 A1 4/2009 Iwamoto
(Continued)

FOREIGN PATENT DOCUMENTS

JP 2000-303838 A 10/2000
JP 2000303838 A * 10/2000
(Continued)

OTHER PUBLICATIONS

International Search Report (PCT/ISA/220 & PCT/ISA/210) issued in PCT Application No. PCT/JP2018/035141 dated Dec. 18, 2018 (five pages).
(Continued)

*Primary Examiner* — Jacob M Amick
*Assistant Examiner* — Charles J Brauch
(74) *Attorney, Agent, or Firm* — Crowell & Moring LLP

(57) ABSTRACT

A hydraulic drive fan control device is provided with a variable displacement hydraulic pump, a hydraulic motor, a hydraulic drive fan that is driven by the hydraulic motor, a flow amount control valve, a rotational speed detector that detects a rotational speed of an engine, and a controller. The controller outputs a first valve control signal to the flow amount control valve and outputs a first pump control signal to the hydraulic pump to rotate the hydraulic drive fan at a first rotational speed, and outputs a second valve control signal to the flow amount control valve and outputs a second pump control signal to the hydraulic pump, thereby stopping the rotation of the hydraulic drive fan.

5 Claims, 16 Drawing Sheets

(51) Int. Cl.
*F01P 11/18* (2006.01)
*F04D 27/00* (2006.01)

(56) References Cited

U.S. PATENT DOCUMENTS

| | | | | |
|---|---|---|---|---|
| 2011/0014062 | A1 | 1/2011 | Imaizumi et al. | |
| 2011/0293439 | A1* | 12/2011 | Imaizumi | F04D 25/08 417/42 |
| 2012/0205171 | A1* | 8/2012 | Takishita | B60K 25/02 180/68.1 |
| 2016/0201545 | A1* | 7/2016 | Kanehama | E02F 9/2095 60/456 |

FOREIGN PATENT DOCUMENTS

| | | | |
|---|---|---|---|
| JP | 2005-76525 | A | 3/2005 |
| JP | 2009-243389 | A | 10/2009 |
| JP | 2016-169795 | A | 9/2016 |
| WO | WO 2006/008875 | A1 | 1/2006 |
| WO | WO 2006/028042 | A1 | 3/2006 |
| WO | WO 2010/110059 | A1 | 9/2010 |
| WO | WO 2011/155309 | A1 | 12/2011 |
| WO | WO 2015/133012 | A1 | 9/2015 |

OTHER PUBLICATIONS

Japanese-language Written Opinion (PCT/ISA/237) issued in PCT Application No. PCT/JP2018/035141 dated Dec. 18, 2018 (five pages).

* cited by examiner

HYDRAULIC DRIVE FAN CONTROL DEVICE

TECHNICAL FIELD

The present invention relates to a control device for a hydraulic drive fan that supplies cooling air to a heat exchange device.

BACKGROUND ART

A construction machine of a dump truck or the like is provided with a heat exchange device of a radiator that cools engine cooling water, an oil cooler that cools hydraulic oil and the like, and a cooling fan that supplies cooling air to the heat exchange device, which are mounted thereon. There is known a hydraulic drive fan, which is driven by a hydraulic motor, as this cooling fan. The hydraulic motor is rotated by pressurized oil that is delivered from a hydraulic pump driven by a prime mover of an engine or the like, and the hydraulic drive fan is driven and rotated by the hydraulic motor.

A dump truck that works in an excavating site of a mine or the like loads cargos of earth and sand or the like excavated using a hydraulic excavator or the like, on a loading platform, and carries the cargoes to a destination. The dump truck travels for a large part of working hours and stops when the cargo is loaded on the loading platform and when the cargo loaded on the loading platform is unloaded. In addition, the dump truck performs an unloading work of the cargo by inclining the loading platform by a hoist cylinder in the stopped state.

An engine rotational speed of the dump truck is relatively stable at the traveling time but, when the dump truck stops at a place for performing a loading work or unloading work, the engine rotational speed varies minutely caused by adjusting a stopping position or a traveling speed. Meanwhile, at the unloading work time, the engine rotational speed varies minutely due to changing a delivery flow amount of the hydraulic pump in accordance with a speed, an operation and the like of expanding and contracting the hoist cylinder. In this way, since the flow amount of the hydraulic pump fluctuates when the engine rotational speed varies, a rotational speed of the hydraulic drive fan also varies.

In general, in a case of controlling the rotational speed of the hydraulic drive fan, feedback control and PI control (proportional and integral control) are executed such that a deviation between a target fan rotational speed and an actual fan rotational speed becomes equal to 0. However, in a case of using the feedback control or the PI control for controlling the rotational speed of the hydraulic drive fan, a peak pressure (a surge pressure) or pressure hunching tends to be easily generated in a hydraulic circuit for driving the hydraulic drive fan. As a result, not only the rotational speed of the hydraulic drive fan tends to easily vary, but also there is a problem that hydraulic equipment devices such as a hydraulic motor, a hydraulic hose and the like configuring the hydraulic circuit are damaged. Meanwhile, the rotational speed of the hydraulic drive fan abruptly varies largely, which introduces damages of blades of the fan, and the like. In addition, when the pressure hunching is generated, fluctuations (pressure variation) or repeated stresses are generated in the inside of the hydraulic equipment devices configuring the hydraulic circuit, which introduces abrasion and a reduction in strength of the hydraulic equipment devices.

On the contrary, there is proposed a control device for a hydraulic drive fan that is provided with a hydraulic drive fan that is driven by a hydraulic motor, a variable displacement hydraulic pump that is driven by an engine and delivers pressurized oil to the hydraulic motor, a control valve that controls a capacity of the variable displacement hydraulic pump, and a controller that sends an instruction signal to the control valve. In the control device for the hydraulic drive fan, the controller calculates a target fan rotational speed based upon an engine water temperature, a hydraulic oil temperature and an engine rotational speed. The controller outputs a current instruction required for causing a fan rotational speed to match the target fan rotational speed to the control valve to feedback control the fan rotational speed (Patent Document 1).

In the control device for the hydraulic drive fan according to Patent Document 1, the rotational speed control of the fan is executed by the PI control for suppressing an abrupt variation of the fan rotational speed, and the integral action is cancelled when it is required to largely move the control valve, limiting a control amount of the control valve to a predetermined change amount. As a result, generation of the peak pressure in the oil path for connection of the hydraulic pump and the hydraulic motor and generation of the pressure hunching in the delivery pressure from the hydraulic motor can be prevented.

PRIOR ART DOCUMENT

Patent Document

Patent Document 1: Japanese Patent Laid-Open No. 2009-243389 A

SUMMARY OF THE INVENTION

However, in the control device for the hydraulic drive fan according to Patent Document 1, the control amount of the control valve is suppressed to the predetermined change amount when it is required to largely move the control valve, the responsiveness of the feedback control deteriorates. Since the delivery flow amount of the hydraulic pump is largely affected by not only the capacity of the hydraulic pump but also the engine rotational speed, in a case where the engine rotational speed varies minutely at the loading work or unloading work time as in the case of the dump truck, the fan rotational speed cannot be matched to the target fan rotational speed to be incapable of suppressing the variation of the fan rotational speed. As a result, there is posed a problem that the peak pressure or the pressure hunching is generated in the hydraulic circuit for driving the hydraulic drive fan.

The present invention is made in view of the aforementioned problems in the conventional technology, and an object of the present invention is to provide a hydraulic drive fan control device that can suppress variation in a fan rotational speed to suppress generation of a peak pressure or pressure hunching in a hydraulic circuit.

The present invention is applied to a hydraulic drive fan control device comprising: a variable displacement hydraulic pump that is driven by a prime mover and varies a delivery capacity in response to a control signal to be inputted to a capacity variable part; a hydraulic motor that is driven by pressurized oil to be delivered from the variable displacement hydraulic pump; a hydraulic drive fan that is driven by the hydraulic motor; a flow amount control valve that is disposed in an oil path establishing connection between the variable displacement hydraulic pump and the hydraulic motor and varies a flow amount of the pressurized oil to be delivered to the hydraulic motor in response to a control signal to be inputted to a pilot part; a rotational speed detector that detects a rotational speed of the prime mover; and a controller that outputs a control signal to the variable displacement hydraulic pump and the flow amount control valve based upon a detection value of the rotational speed detector.

The present invention is characterized in that the controller includes a calculation control section configured to: when an output time of a timer continues for a constant time or more in a state where the detection value of the rotational speed detector is kept as a value equal to or more than a predetermined threshold value, output a first valve control signal to the flow amount control valve for rotating the hydraulic drive fan at a first rotational speed; when the output time of the timer does not continue for the constant time or more in a state where the detection value of the rotational speed detector is kept as the value equal to or more than the threshold value, output a second valve control signal by which the flow amount is minimized, to the flow amount control valve for stopping rotation of the hydraulic drive fan; when the output time of the timer continues for the constant time or more in a state where the detection value of the rotational speed detector is kept as the value equal to or more than the threshold value, output a first pump control signal to the variable displacement hydraulic pump for rotating the hydraulic drive fan at the first rotational speed; and when the output time of the timer does not continue for the constant time or more in a state where the detection value of the rotational speed detector is kept as the value equal to or more than the threshold value, output a second pump control signal by which the delivery capacity is minimized, to the variable displacement hydraulic pump for stopping the rotation of the hydraulic drive fan.

According to the present invention, the first valve control signal is outputted to the flow amount control valve from the calculation control section and the first pump control signal is outputted to the variable displacement hydraulic pump, whereby the hydraulic drive fan can be rotated at the first rotational speed. Meanwhile, the second valve control signal is outputted to the flow amount control valve from the calculation control section and the second pump control signal is outputted to the variable displacement hydraulic pump, whereby the rotation of the hydraulic drive fan can be stopped. As a result, the rotational speed of the hydraulic drive fan can be suppressed from varying minutely following the variation in the rotational speed of the prime mover, and the peak pressure or the pressure hunching in the hydraulic circuit connected to the hydraulic drive fan can be suppressed from being generated.

MODE FOR CARRYING OUT THE INVENTION

Hereinafter, an explanation will be in detail made of a hydraulic drive fan control device according to the present invention with reference to the accompanying drawings.

Figure 1:
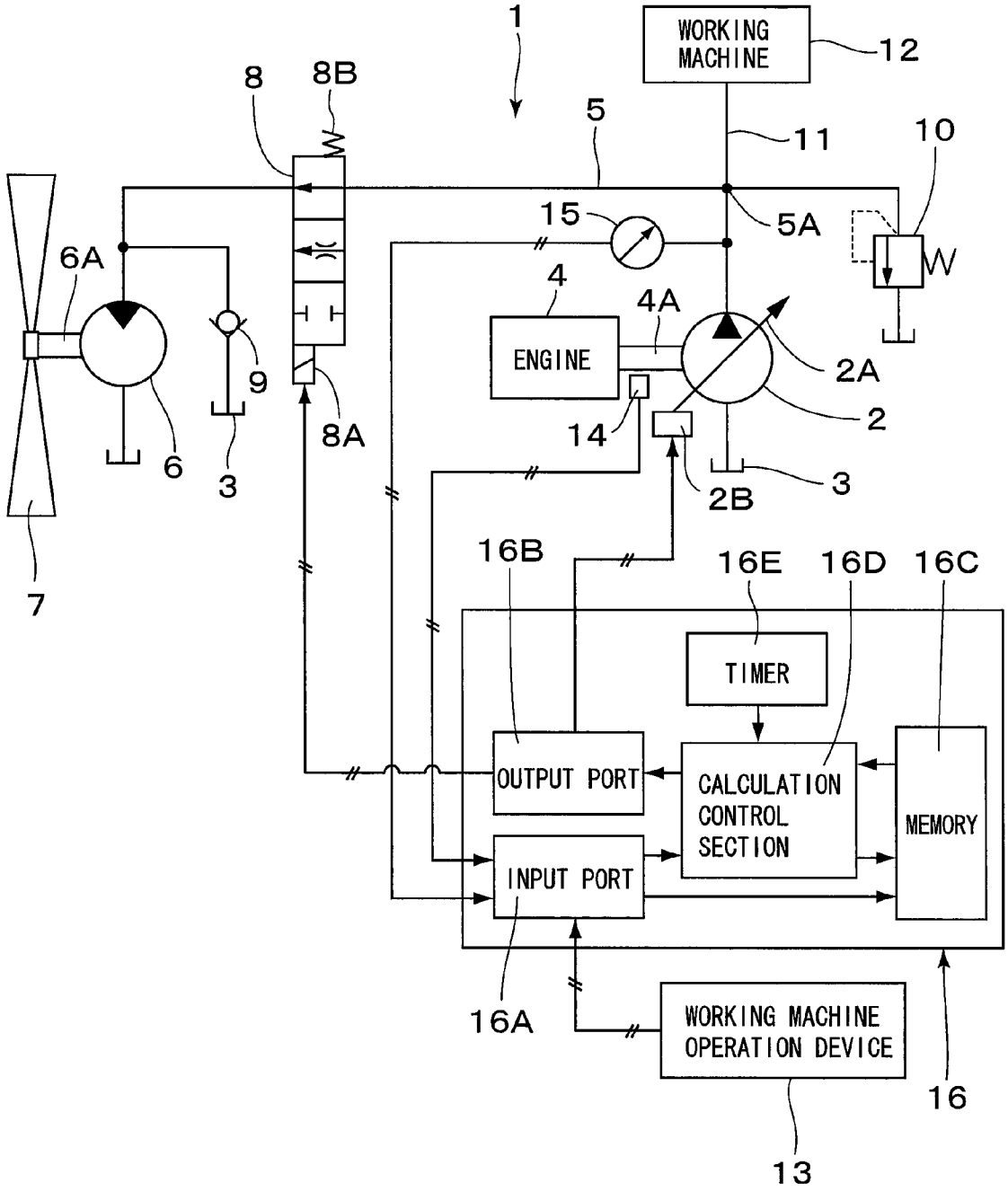
FIG. 1 is a configuration diagram of a hydraulic drive fan control device according to a first embodiment of the present invention.

FIG. 1 to FIG. 8 show a first embodiment of the present invention. A hydraulic drive fan control device 1 as shown in FIG. 1 is mounted on a construction machine such as a dump truck. The hydraulic drive fan control device 1 is configured of a hydraulic pump 2, a hydraulic motor 6, a hydraulic drive fan 7, a flow amount control valve 8, a rotational speed detector 14, a pressure detector 15, a controller 16 and the like.

The variable displacement hydraulic pump 2 (hereinafter, referred to as "hydraulic pump 2") configures a hydraulic source together with a tank 3. The hydraulic pump 2 is connected to an output shaft 4A of an engine 4 and is driven by the engine 4. A suction port of the hydraulic pump 2 is connected to the tank 3, and a delivery port of the hydraulic pump 2 is connected via a fan pipe line 5 to an inflow port of a hydraulic motor 6. The hydraulic pump 2 suctions hydraulic oil in the tank 3 and delivers pressurized oil to the fan pipe line 5. A delivery flow amount Q1 (L/min) of the hydraulic pump 2 is a value found by multiplying a pump capacity q1 (cc/rev) of the hydraulic pump 2 by an engine rotational speed N1 ($min^{-1}$) of the engine 4.

The hydraulic pump 2 is configured such that a pump capacity changes by changing a tilting angle of a swash plate 2A, for example, and has an electromagnetic drive regulator 2B as a capacity variable part. The regulator 2B changes the tilting angle of the swash plate 2A in accordance with a pump control amount Cp (A) to be supplied from the controller 16 to change the pump capacity of the hydraulic pump 2. The pump control amount Cp is supplied to the regulator 2B as an instruction current (a pump control signal) from the controller 16. It should be noted that a hybrid prime mover composed of an electric motor or by a combination of an engine and an electric motor may be used as a prime mover that drives the hydraulic pump 2.

The hydraulic motor 6 is configured of a fixed capacity hydraulic motor. A hydraulic drive fan 7 is attached to an output shaft 6A of the hydraulic motor 6. The hydraulic motor 6 is driven by pressurized oil supplied to an inflow port from the hydraulic pump 2 to rotate the hydraulic drive fan 7. The inflow port of the hydraulic motor 6 is connected via the fan pipe line 5 to a delivery port of the hydraulic pump 2 and an outflow port of the hydraulic motor 6 is connected to the tank 3. Here, a rotational speed N2 ($min^{-1}$) of the hydraulic motor 6 is a value found by dividing a flow amount Q2 (L/min) of the pressurized oil to be supplied to the hydraulic motor 6 through a flow amount control valve 8 by a capacity q2 (cc/rev) of the hydraulic motor 6.

The hydraulic drive fan 7 is attached to the output shaft 6A of the hydraulic motor 6 and is driven by the hydraulic motor 6. In the present embodiment, a rotational speed of the hydraulic drive fan 7 is equal to a rotational speed of the hydraulic motor 6. The hydraulic drive fan 7 is composed of an axial-flow fan, and supplies cooling air to, for example, heat exchangers of a radiator, an oil cooler and the like (none of them is shown), which are mounted on a dump truck. Power L2 (kW) at some rotational speed of the hydraulic drive fan 7, pressure P2 (MPa) of the pressurized oil to be supplied to the hydraulic motor 6 and a flow amount Q2 (L/min) of the pressurized oil through the flow amount control valve 8 to be supplied to the hydraulic motor 6 have a relation of the following Formula 1.

$$P2 = \frac{L2}{Q2} \times 60 \quad \text{[Formula 1]}$$

The flow amount control valve 8 is disposed in the halfway of the fan pipe line 5 to be positioned between the hydraulic pump 2 and the hydraulic motor 6. The flow amount control valve 8 is configured of an electromagnetic valve having a solenoid part 8A as a pilot part. The flow amount control valve 8 opens against a spring 8B by a control signal to be inputted to the solenoid part 8A from the controller 16. The flow amount control valve 8 changes an opening area (a valve opening) in accordance with a valve control amount Cv (A) to be inputted to the solenoid part 8A from the controller 16. The valve control amount Cv is supplied to the solenoid part 8A as an instruction current (a valve control signal) from the controller 16.

Here, the flow amount Q2 (L/min) of the pressurized oil to be supplied to the hydraulic motor 6 through the flow amount control valve 8 can be found according to the following Formula 2. It should be noted that in Formula 2, C is a contraction coefficient. The contraction coefficient C is defined by shapes of the fan pipe line 5 and a flow path of the flow amount control valve 8, a flow speed of the pressurized oil and viscosity of the pressurized oil. A1 ($mm^2$) is an opening area of the flow amount control valve 8. P1 (MPa) is a delivery pressure (a pressure of the pressurized oil in the fan pipe line 5) of the hydraulic pump 2. P2 (MPa) is a pressure of the pressurized oil to be supplied to the hydraulic motor 6. ρ ($kg/m^3$) is density of the pressurized oil.

$$Q2 = C \cdot A1 \times \sqrt{\frac{2(P1 - P2)}{\rho}} \quad \text{[Formula 2]}$$

A check valve 9 is connected to the halfway of the fan pipe line 5 to be positioned between the hydraulic motor 6 and the flow amount control valve 8. The check valve 9 allows flow of the hydraulic oil toward the fan pipe line 5 from the tank 3 and blocks the reverse flow. For example, in a state where the hydraulic drive fan 7 is rotating, in a case where the opening area of the flow amount control valve 8 becomes equal to 0 to stop the supply of the pressurized oil to the hydraulic motor 6, a negative pressure is generated in the inflow port side of the hydraulic motor 6. When the negative pressure is generated in the inflow port side of the hydraulic motor 6, the check valve 9 is operable to supply the hydraulic oil in the tank 3 to the inflow port of the hydraulic motor 6. Thereby, the rotational speed of the hydraulic motor 6 can be suppressed from varying (stopping) abruptly.

A relief valve 10 is disposed in the halfway of the fan pipe line 5. The inflow port of the relief valve 10 is connected to the fan pipe line 5 and the outflow port of the relief valve 10 is connected to the tank 3. The relief valve 10 sets a delivery pressure of the pressurized oil to be delivered to the fan pipe line 5 from the hydraulic pump 2 and discharges an extra pressure exceeding the set delivery pressure to the tank 3. The relief valve 10 defines the maximum pressure in the hydraulic circuit for driving the hydraulic drive fan 7.

A working machine pipe line 11 is connected to a branch point 5A disposed in the halfway of the fan pipe line 5. The branch point 5A is disposed between the hydraulic pump 2 and the flow amount control valve 8. A working machine 12 composed of a hydraulic actuator is connected to the working machine pipe line 11. For example, a hydraulic actuator (not shown) such as a hoist cylinder lifting/lowering a loading platform of a dump truck is used as the working machine 12 and lifts/lowers the loading platform of the dump truck in response to delivery of the pressurized oil from the hydraulic pump 2.

A working machine operation device 13 is disposed in an operator's room (not shown) of a dump truck, for example. The working machine operation device 13 is operated for driving the working machine 12 of the hoist cylinder or the like, and the working machine 12 is driven in accordance with an operation amount of the working machine operation device 13. The working machine operation device 13 is connected to an input port 16A of the controller 16, and a detection signal in accordance with the operation amount to the working machine operation device 13 is supplied to the input port 16A.

The rotational speed detector 14 is disposed in the vicinity of the engine 4 and is connected to the input port 16A of the controller 16. The rotational speed detector 14 detects the engine rotational speed N1 ($min^{-1}$) as the rotational speed of the output shaft 4A of the engine 4 and supplies a detection signal in accordance with this rotational speed to the input port 16A of the controller 16.

The pressure detector 15 is disposed in the halfway of the fan pipe line 5 to be positioned between the hydraulic pump 2 and the flow amount control valve 8. The pressure detector 15 is connected to the input port 16A of the controller 16.

The pressure detector 15 detects the delivery pressure P1 (MPa) of the hydraulic pump 2 that has performed the delivery to the fan pipe line 5 and supplies a detection signal in accordance with this pressure to the input port 16A in the controller 16.

The controller 16 includes the input port 16A, an output port 16B, a memory 16C, a calculation control section 16D, a timer 16E and the like. The input port 16A is connected to the working machine operation device 13, the rotational speed detector 14 and the pressure detector 15. The output port 16B is connected to the regulator 2B of the hydraulic pump 2 and the solenoid part 8A of the flow amount control valve 8. The calculation control section 16D supplies a control signal to the regulator 2B of the hydraulic pump 2 and the solenoid part 8A of the flow amount control valve 8 based upon detection signals to be supplied to the input port 16A from the working machine operation device 13, the rotational speed detector 14 and the pressure detector 15 and an output time from the timer 16E. That is, the calculation control section 16D configures a valve control part and a pump control part. The timer 16E is connected to the calculation control section 16D.

Figure 2:
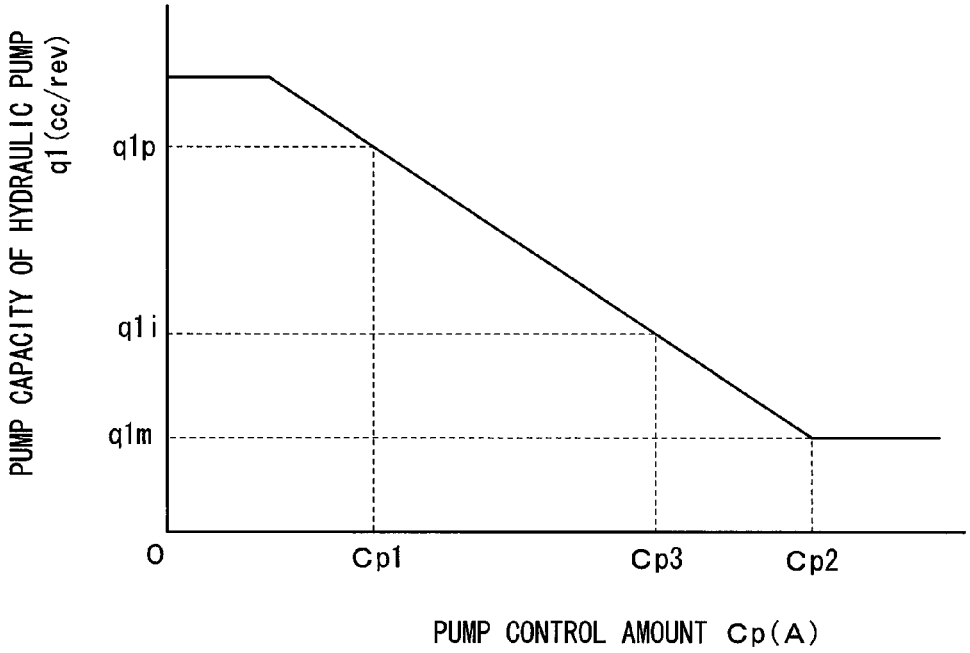
FIG. 2 is a characteristic line diagram showing a relation between a pump control amount to be inputted to a regulator in a hydraulic pump and a pump capacity of the hydraulic pump.

Here, a relation between the pump control amount Cp (A) as the pump control signal to be inputted to the regulator 2B of the hydraulic pump 2 and the pump capacity q1 (cc/rev) of the hydraulic pump 2 is shown as a characteristic line diagram in FIG. 2. That is, in a case where the pump control amount Cp becomes equal to a first pump control amount Cp1 as a first pump control signal, the pump capacity q1 becomes a pump capacity q1*p* at the fan predetermined rotational speed time to be described later. In a case where the pump control amount Cp becomes equal to or more than a second pump control amount Cp2 as a second pump control signal, the pump capacity q1 becomes a minimum pump capacity q1*m*. In a case where the pump control amount Cp becomes equal to a third pump control amount Cp3 as a third pump control signal, the pump capacity q1 becomes a pump capacity q1*i* at the fan idling rotational speed time to be described later.

Figure 3:
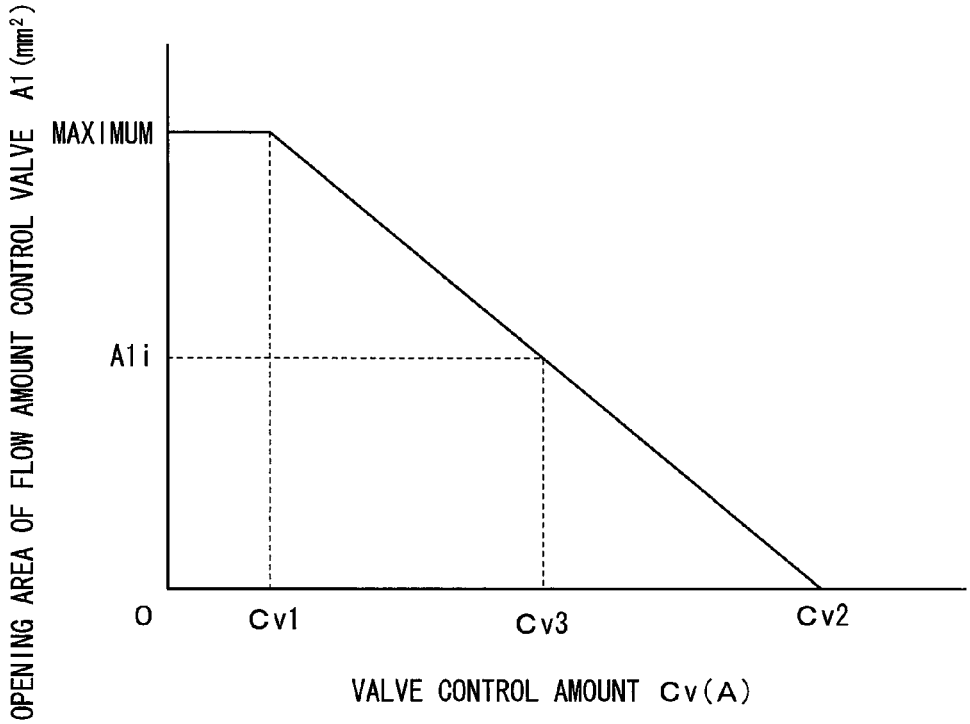
FIG. 3 is a characteristic line diagram showing a relation between a valve control amount to be inputted to a pilot part in a flow amount control valve and an opening area of the flow amount control valve.

Meanwhile, a relation between the valve control amount Cv (A) as the valve control signal to be inputted to the solenoid part 8A of the flow amount control valve 8 and the opening area A1 ($mm^2$) of the flow amount control valve 8 is shown as a characteristic line diagram in FIG. 3. That is, in a case where the valve control amount Cv becomes equal to or less than a first valve control amount Cv1 as a first valve control signal, the opening area A1 becomes a maximum opening area. In a case where the valve control amount Cv becomes equal to or more than a second valve control amount Cv2 as a second valve control signal, the opening area A1 becomes equal to 0. In a case where the valve control amount Cv becomes equal to a third valve control amount Cv3 as a third valve control signal, the opening area A1 becomes an opening area A1*i* at the fan idling rotational speed time.

The hydraulic drive fan control device 1 according to the first embodiment has the configuration as described above. Next, an explanation will be made of an operation of the hydraulic drive fan control device 1 with reference to FIG. 4 to FIG. 7.

Figure 4:
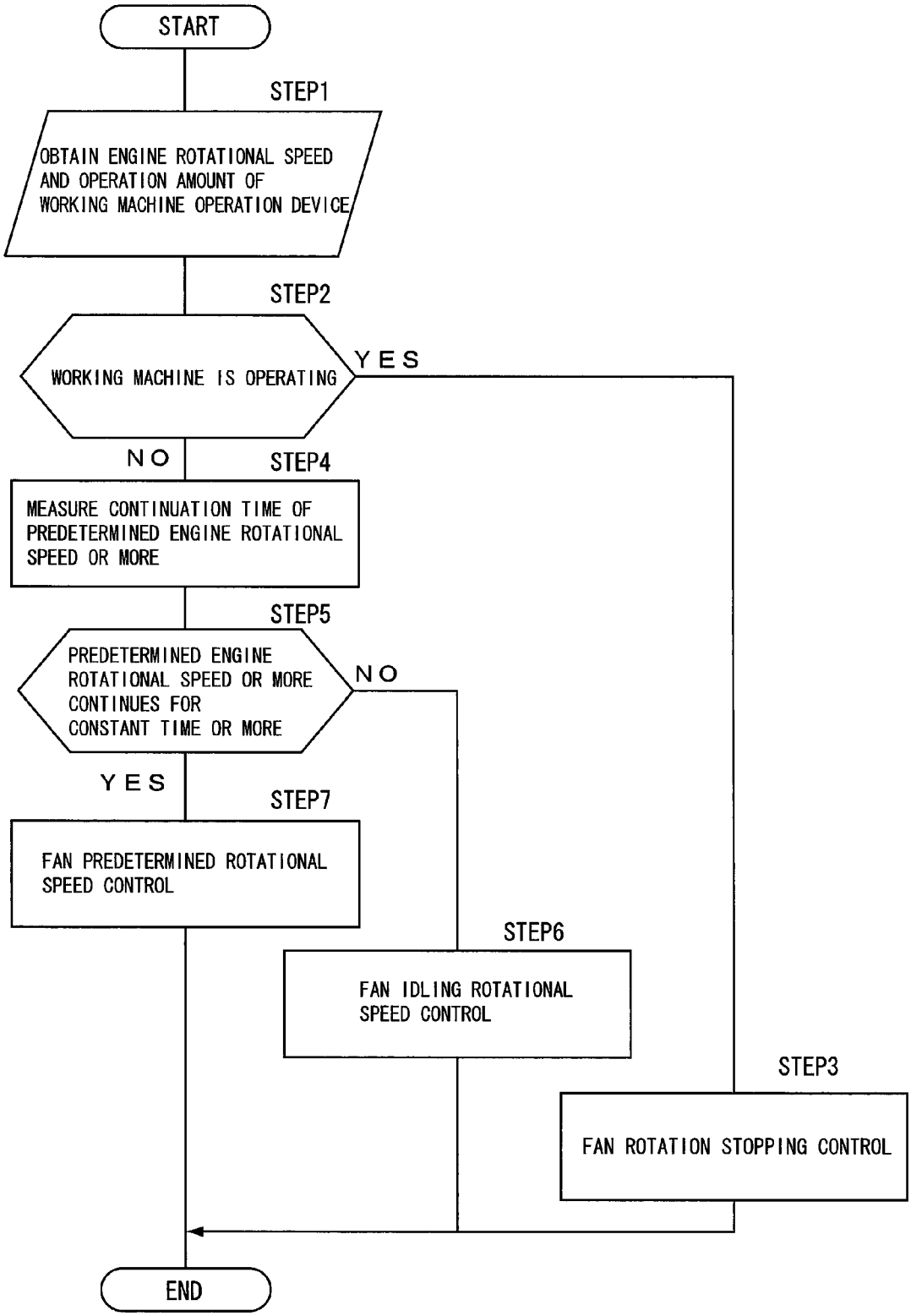
FIG. 4 is a flow chart showing determination processing of fan predetermined rotational speed control, fan idling rotational speed control and fan rotation stopping control by controller.

In a case where the dump truck on which the hydraulic drive fan control device 1 is mounted starts from the stopped state, the controller 16 executes the determination processing as shown in FIG. 4. Thereby, the controller 16 determines which one of fan predetermined rotational speed control, fan idling rotational speed control and fan rotation stopping control should be applied to the hydraulic drive fan 7. At this time, the calculation control section 16D in the controller 16 sets an initial value of a fan predetermined rotational speed flag to OFF, an initial value of a fan idling rotational speed flag to OFF, and an initial value of a fan rotation stopping flag to ON. In addition, the hydraulic pump 2 is set to the minimum pump capacity q1*m* by the regulator 2B.

First, the controller 16 obtains the engine rotational speed N1 detected by the rotational speed detector 14 and the operation amount of the working machine operation device 13 in step 1, which are stored in the memory 16C. A plurality of pieces of the engine rotational speeds N1 in the past are stored in the memory 16C. In a case where the piece number of the stored engine rotational speeds N1 reaches the maximum value, the engine rotational speed is in order updated to the latest engine rotational speed N1.

Figure 7:
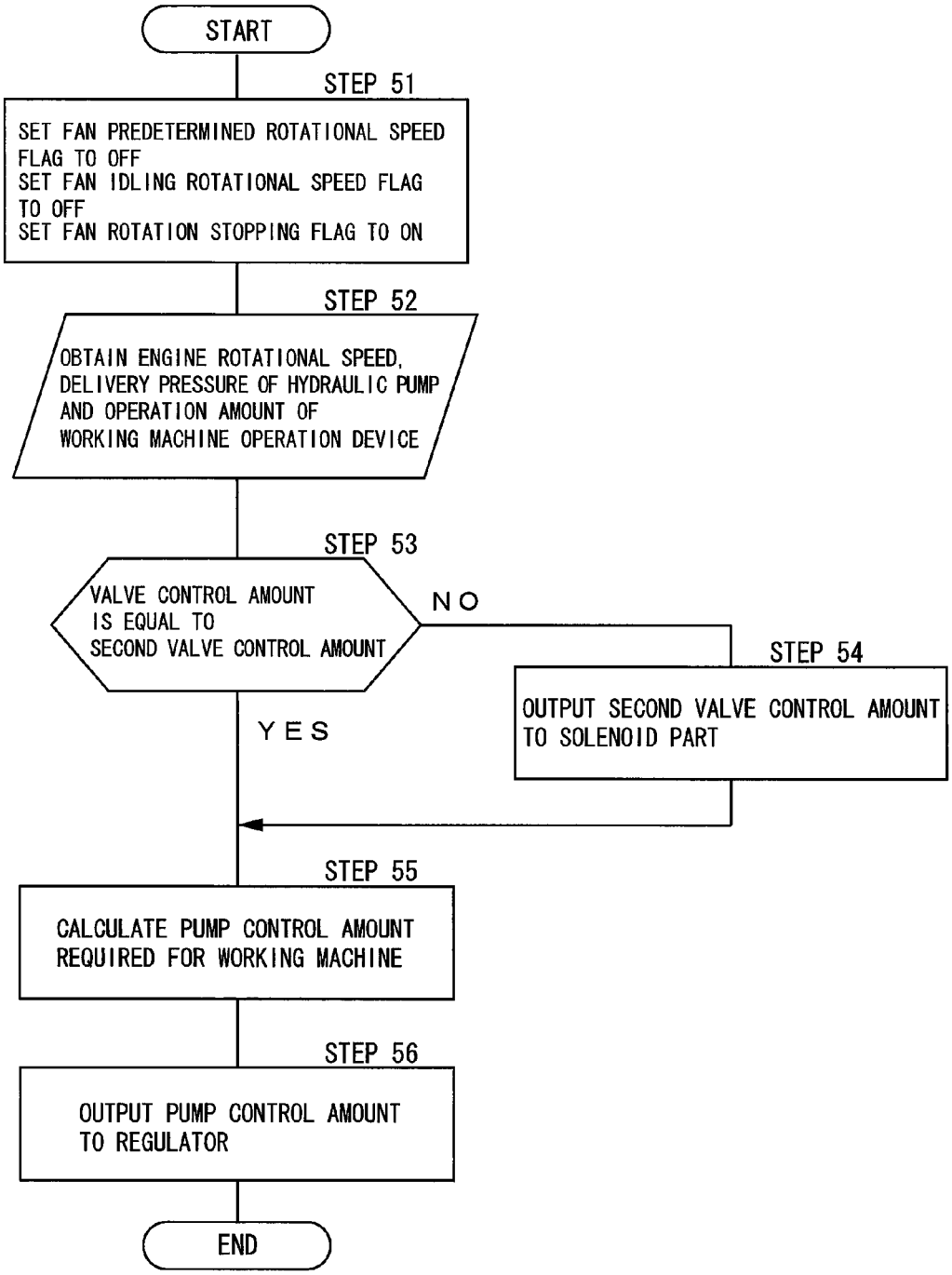
FIG. 7 is a flow chart showing a processing content of the fan rotation stopping control.

Next, in step 2, the calculation control section 16D determines whether or not the working machine 12 is operated by the working machine operation device 13. In a case where "YES" is determined in step 2, that is, in a case where the working machine 12 is operated, the process goes to step 3, wherein the fan rotation stopping control as shown in FIG. 7 is executed.

In a case where "NO" is determined in step 2, that is, in a case where the working machine 12 is not operated, the process goes to step 4. The calculation control section 16D measures a continuation time during which the engine rotational speed N1 is equal to or more than a predetermined threshold value (hereinafter, referred to as "predetermined engine rotational speed N1*s*") in step 4. In this case, the calculation control section 16D measures the continuation time during which the engine rotational speed N1 is equal to or more than the predetermined engine rotational speed N1*s* based upon the plurality of pieces of engine rotational speeds N1 stored in the memory 16C and an interval time (a memory cycle of the memory 16C based upon the output time of the timer 16E) for executing the memory processing of the engine rotational speed N1.

Figure 5:
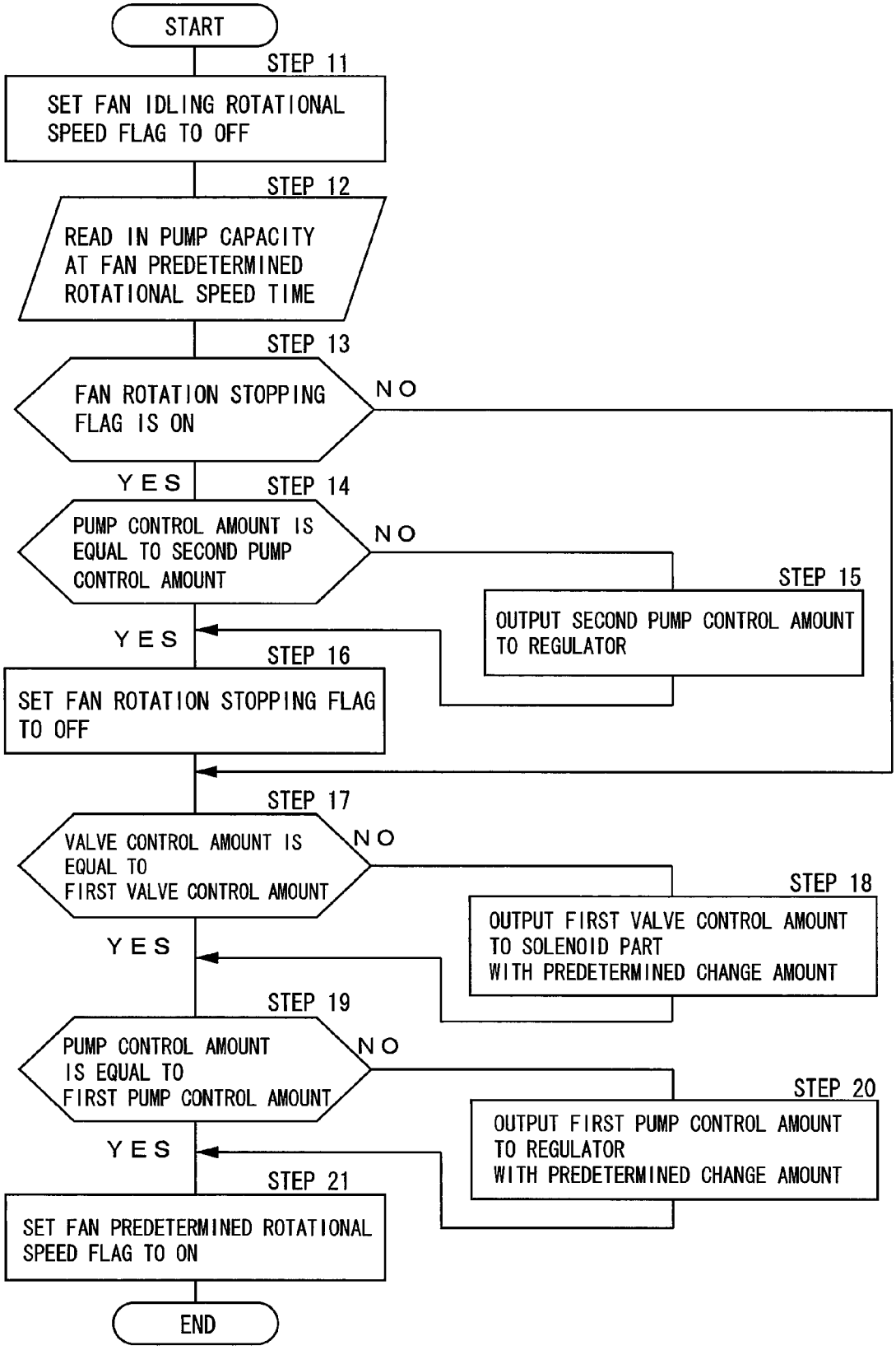
FIG. 5 is a flow chart showing a processing content of the fan predetermined rotational speed control.
Figure 6:
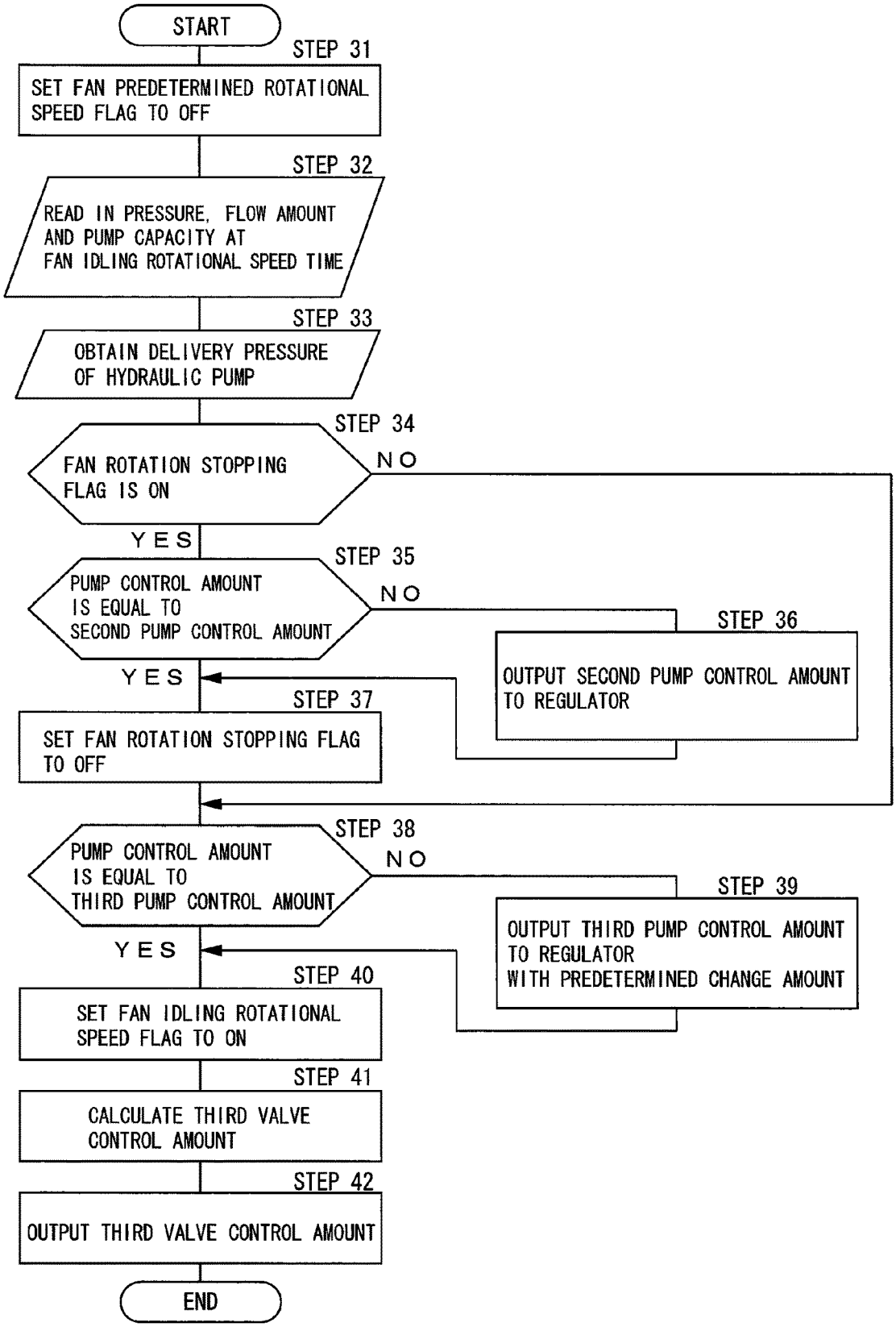
FIG. 6 is a flow chart showing a processing content of the fan idling rotational speed control.

Next, in step 5, the calculation control section 16D determines whether or not the output time of the timer 16E continues for a constant time or more in a state where the engine rotational speed N1 is kept as a value equal to or more than the predetermined engine rotational speed Nis. In a case where "NO" is determined in step 5, the process goes to step 6, wherein the fan idling rotational speed control as shown in FIG. 6 is executed. Meanwhile, in a case where "YES" is determined in step 5, the process goes to step 7, wherein the fan predetermined rotational speed control as shown in FIG. 5 is executed.

In this way, the controller 16 executes the fan predetermined rotational speed control in a case where the output time of the timer 16E continues for the constant time or more in a state where the engine rotational speed N1 is kept as the value equal to or more than the predetermined engine rotational speed N1*s* in a state where the working machine 12 is not operated. This fan predetermined rotational speed control rotates the hydraulic drive fan 7 at a fan predetermined rotational speed as a first rotational speed. In addition, the controller 16 executes the fan idling rotational speed control in a case where the output time of the timer 16E does not continue for the constant time or more in a state where the engine rotational speed N1 is kept as the value equal to or more than the predetermined engine rotational speed N1*s* in a state where the working machine 12 is not operated. The fan idling rotational speed control rotates the hydraulic drive fan 7 at a fan idling rotational speed as a second rotational speed lower than the fan predetermined rotational speed.

Further, the controller 16 executes the fan rotation stopping control that stops the hydraulic drive fan 7 in a case where the working machine 12 is operated.

Next, an explanation will be made of the fan predetermined rotational speed control by the controller 16 with reference to FIG. 5. In this case, the fan predetermined rotational speed of the hydraulic drive fan 7 corresponds to the first rotational speed to be set when the output time of the timer 16E continues for the constant time or more in a state where the engine rotational speed N1 is kept as the value equal to or more than the predetermined engine rotational speed N1*s* as a threshold value.

In the fan predetermined rotational speed control as shown in FIG. 5, the calculation control section 16D sets a fan idling rotational speed flag to OFF in step 11, and thereafter, reads in the pump capacity q1*p* of the hydraulic pump 2 at the fan predetermined rotational speed time from the memory 16C in step 12. The pump capacity q1*p* of the hydraulic pump 2 at the fan predetermined rotational speed time is in advance defined and is stored in the memory 16C.

Next, in step 13, the calculation control section 16D determines whether or not the fan rotation stopping flag is ON. In a case where "NO" is determined in step 13, the process goes to step 17, and in a case where "YES" is determined in step 13, the process goes to step 14. In step 14, the calculation control section 16D determines whether or not the pump control amount Cp to be outputted to the regulator 2B of the hydraulic pump 2 is equal to the second pump control amount (the second pump control signal) Cp2 for setting the hydraulic pump 2 to the minimum pump capacity q1*m*.

In a case where "NO" is determined in step 14, the process goes to step 15. In step 15, the calculation control section 16D outputs the second pump control signal Cp2 to the regulator 2B of the hydraulic pump 2 and sets the hydraulic pump 2 to the minimum pump capacity q1*m*, and thereafter, the process goes to step 16. In this way, in an initial stage where the hydraulic drive fan 7 transfers to the fan predetermined rotational speed, the step 13 to step 15 are executed, whereby the pump capacity q1 of the hydraulic pump 2 at the starting time of the hydraulic drive fan 7 once becomes equal to the minimum pump capacity q1*m*. As a result, the rotation of the hydraulic drive fan 7 can be suppressed from varying abruptly.

In a case where "YES" is determined in step 14, in step 16, the calculation control section 16D sets the fan rotation stopping flag to OFF, and then, the process goes to step 17. In step 17, the calculation control section 16D determines whether or not the valve control amount Cv to be outputted to the solenoid part 8A of the flow amount control valve 8 is equal to the first valve control amount (the first valve control signal) Cv1 for maximizing the opening area A1 of flow amount control valve 8. In a case where "NO" is determined in step 17, in step 18, the calculation control section 16D outputs the first valve control amount Cv1 to the solenoid part 8A to maximize the opening area A1 of the flow amount control valve 8. In this case, the calculation control section 16D outputs the first valve control amount Cv1 to the solenoid part 8A with a predetermined change amount per a predetermined unit time. In this way, in an initial stage where the hydraulic drive fan 7 transfers to the fan predetermined rotational speed, the step 17 and step 18 are executed, whereby it is possible to gradually increase the flow amount of the pressurized oil to be supplied to the hydraulic motor 6 at the starting time of the hydraulic drive fan 7. As a result, the rotation of the hydraulic drive fan 7 can be suppressed from varying abruptly.

In a case where "YES" is determined in step 17, in step 19, the calculation control section 16D determines whether or not the pump control amount Cp to be outputted to the regulator 2B of the hydraulic pump 2 is equal to the first pump control amount (the first pump control signal) Cp1 for setting the hydraulic pump 2 to the pump capacity q1*p* at the fan predetermined rotational speed time. In a case where "NO" is determined in step 19, in step 20, the calculation control section 16D outputs the first pump control amount Cp1 to the regulator 2B and sets the hydraulic pump 2 to the pump capacity q1*p* at the fan predetermined rotational speed time. In this case, the calculation control section 16D outputs the first pump control amount Cp1 with a predetermined change amount per a predetermined unit time. In this way, in an initial stage where the hydraulic drive fan 7 transfers to the fan predetermined rotational speed, the step 19 and step 20 are executed, whereby at the starting time of the hydraulic drive fan 7, it is possible to gradually increase the pump capacity q1 of the hydraulic pump 2 to the pump capacity q1*p* at the fan predetermined rotational speed time. As a result, the rotation of the hydraulic drive fan 7 can be suppressed from varying abruptly.

In a case where "YES" is determined in step 19, since the pump capacity q1 of the hydraulic pump 2 becomes equal to the pump capacity q1*p* at the fan predetermined rotational speed time, the hydraulic motor 6 can rotate the hydraulic drive fan 7 at the fan predetermined rotational speed. In addition, the calculation control section 16D sets the fan predetermined rotational speed flag to ON in step 21, and thereafter, ends the control processing.

Next, an explanation will be made of the fan idling rotational speed control by the controller 16 with reference to FIG. 6. In this case, the fan idling rotational speed of the hydraulic drive fan 7 corresponds to the second rotational speed to be set when the output time of the timer 16E does not continue for the constant time or more in a state where the engine rotational speed N1 is kept as the value equal to or more than the predetermined engine rotational speed N1*s* as a threshold value. The fan idling rotational speed is set to a value lower than the fan predetermined rotational speed as the first rotational speed and greater than 0 (a state of the rotation stop).

In the fan idling rotational speed control as shown in FIG. 6, the calculation control section 16D sets the fan predetermined rotational speed flag to OFF in step 31, and thereafter, the process goes to step 32. In step 32, the calculation control section 16D reads in a pressure P2*i* (MPa) of the pressurized oil to be supplied to the hydraulic motor 6, a flow amount Q2*i* (L/min) of the pressurized oil passing through the flow amount control valve 8 and a pump capacity q1*i* (cc/rev) of the hydraulic pump 2 at the fan idling rotational speed time from the memory 16C. The pressure P2*i*, the flow amount Q2*i* and the pump capacity q1*i* at the fan idling rotational speed time are in advance defined and are stored in the memory 16C.

Next, in step 33, the calculation control section 16D obtains the delivery pressure P1 of the hydraulic pump 2 based upon the detection signal from the pressure detector 15. In subsequent step 34, the calculation control section 16D determines whether or not the fan rotation stopping flag is ON. In a case where "NO" is determined in step 34, the process goes to step 38, and in a case where "YES" is determined in step 34, the process goes to step 35.

In step 35, the calculation control section 16D determines whether or not the pump control amount Cp to be outputted to the regulator 2B in the hydraulic pump 2 is equal to the second pump control amount (a second pump control signal)

Cp2 to make the pump capacity of the hydraulic pump 2 the minimum pump capacity q1*m*. in a case where "NO" is determined in step 35, the calculation control section 16D outputs the second pump control amount Cp2 to the regulator 2B in step 36 to make the pump capacity of the hydraulic pump 2 the minimum pump capacity q1*m*. In the initial stage where the hydraulic drive fan 7 transfers to the fan idling rotational speed, the step 34 to step 36 are executed, whereby the pump capacity q1 of the hydraulic pump 2 at the starting time of the hydraulic drive fan 7 becomes equal to the minimum capacity once. As a result, the rotation of the hydraulic drive fan 7 can be suppressed from varying abruptly.

In a case where "YES" is determined in step 35, the calculation control section 16D sets the fan rotation stopping flag to OFF in step 37, and thereafter, the process goes to step 38.

In step 38, the calculation control section 16D determines whether or not the pump control amount Cp to be outputted to the regulator 2B in the hydraulic pump 2 is equal to the third pump control amount (a third pump control signal) Cp3 to make the pump capacity of the hydraulic pump 2 the pump capacity q1*i* at the fan idling rotational speed time. In a case where "NO" is determined in step 38, the calculation control section 16D outputs the third pump control amount Cp3 to the regulator 2B in step 39 to make the pump capacity of the hydraulic pump 2 the pump capacity q1*i* at the fan idling rotational speed time. In this case, the calculation control section 16D outputs the third pump control amount Cp3 with a predetermined change amount per a predetermined unit time. In this way, in the initial stage where the hydraulic drive fan 7 transfers to the fan idling rotational speed, the step 38 and step 39 are executed, whereby the pump capacity q1 of the hydraulic pump 2 at the starting time of the hydraulic drive fan 7 can be gradually increased to the pump capacity q1*i* at the fan idling rotational speed time. As a result, the rotation of the hydraulic drive fan 7 can be suppressed from varying abruptly.

In a case where "YES" is determined in step 38, in step 40, the calculation control section 16D sets the fan idling rotation speed flag to ON, and then, the process goes to step 41. In step 41, the calculation control section 16D calculates the third valve control amount (a third valve control signal) Cv3 to be outputted to the solenoid part 8A of the flow amount control valve 8 for controlling the hydraulic drive fan 7 to the fan idling rotation speed. In this case, the calculation control section 16D calculates an opening area A1*i* of the flow amount control valve 8 for the flow amount Q2 of the pressurized oil to be supplied to the hydraulic motor 6 to be equal to the flow amount Q2*i* at the fan idling rotational speed time. The opening area A1*i* of the flow amount control valve 8 is calculated according to the Formula 2 and according to the following Formula 3 on a condition that the pressure P2 of the pressurized oil to be supplied to the hydraulic motor 6 is made to the pressure P2*i* of the pressurized oil supplied to the hydraulic motor 6 at the fan idling rotational speed time. In addition, the calculation control section 16D calculates the third valve control amount Cv3 to be outputted to the solenoid part 8A of the flow amount control valve 8 for controlling the flow amount control valve 8 to have the opening area A1*i*.

$$A1i = \frac{Q2i}{C} \times \sqrt{\frac{\rho}{2(P1 - P2i)}} \quad \text{[Formula 3]}$$

Next, the calculation control section 16D outputs the calculated third valve control amount Cv3 to the solenoid part 8A of the flow amount control valve 8 in step 42. Thereby, the opening area A1 of the flow amount control valve 8 becomes equal to the opening area A1*i* at the fan idling rotational speed time, and the hydraulic motor 6 can rotate the hydraulic drive fan 7 at the fan idling rotational speed. In addition, the calculation control section 16D ends the control processing.

Next, an explanation will be made of the fan rotation stopping control by the controller 16 with reference to FIG. 7.

In the fan rotation stopping control as shown in FIG. 7, in step 51, the calculation control section 16D sets the fan predetermined rotational speed flag and the fan idling rotational speed flag to OFF and the fan rotation stopping flag to ON, and the thereafter, the process goes to step 52.

In step 52, the calculation control section 16D obtains the engine rotational speed N1 detected by the rotational speed detector 14, the delivery pressure P1 of the hydraulic pump 2 detected by the pressure detector 15 and the operation amount of the working machine operation device 13.

Next, in step 53, the calculation control section 16D determines whether or not the valve control amount Cv to be outputted to the solenoid part 8A of the flow amount control valve 8 is equal to the second valve control amount (the second valve control signal) Cv2 for making the opening area A1 of flow amount control valve 8 equal to 0. In a case where "NO" is determined in step 53, in step 54, the calculation control section 16D outputs the second valve control amount Cv2 to the solenoid part 8A of the flow amount control valve 8. Thereby, the opening area A1 of the flow amount control valve 8 becomes equal to 0 to transfer the rotational speed N2 of the hydraulic motor 6 to 0.

In step 53, in a case where "YES" is determined, in step 55, the calculation control section 16D calculates the pump control amount Cp required for the operation of the working machine 12 based upon the engine rotational speed N1, the delivery pressure P1 of the hydraulic pump 2 and the operation amount of the working machine operation device 13, which are obtained in step 52.

Next, in step 56, the calculation control section 16D outputs the calculated pump control amount Cp to the regulator 2B of the hydraulic pump 2 to set the pump capacity of the hydraulic pump 2 to the pump capacity q1 required for the operation of the working machine 12. As a result, the working machine 12 can operate by the pressurized oil delivered from the hydraulic pump 2. In addition, the calculation control section 16D ends the control processing.

Figure 8:
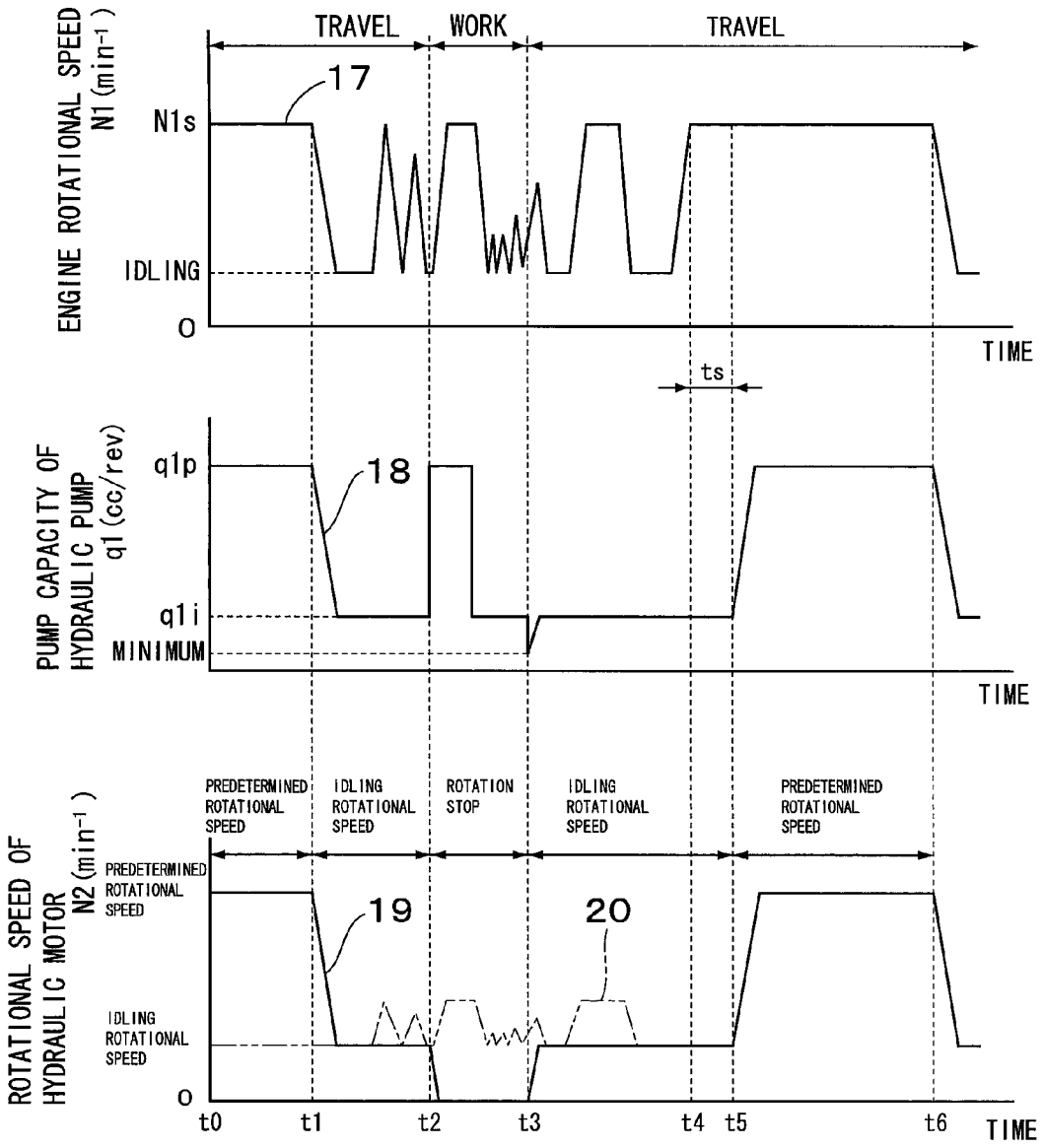
FIG. 8 is a characteristic line diagram showing a temporal relation between an engine rotational speed, a pump capacity of the hydraulic pump and a rotational speed of a hydraulic motor.

Next, an explanation will be made of an operational effect of the hydraulic drive fan control device 1 according to the first embodiment with reference to FIG. 8. FIG. 8 shows a change with time in the engine rotational speed N1, the pump capacity q1 of the hydraulic pump 2 and the rotational speed N2 of the hydraulic motor 6 at the working time of the dump truck.

First, a period from time t0 to time t1 shows a state where the dump truck is traveling toward an unloading area, for example. During the period from time t0 to time t1, the engine rotational speed N1 as shown in a characteristic line 17 is kept as the value of the predetermined engine rotational speed N1*s* or more as the threshold value for the constant time or more. Accordingly, the hydraulic drive fan 7 is controlled by the fan predetermined rotational speed control as shown in FIG. 5 during the period from time t0 to time t1. Thereby, the pump capacity q1 of the hydraulic pump 2 as shown in a characteristic line 18 becomes equal to the pump capacity q1*p* at the fan predetermined rotational speed time during the period from time t0 to time t1. In addition, the opening area A1 of the flow amount control valve 8 is maximized. As a result, the rotational speed N2 of the hydraulic motor 6 for driving the hydraulic drive fan 7 becomes, as shown in a characteristic line 19, equal to the fan predetermined rotational speed during the period from time t0 to time t1.

Next, a period from time t1 to time t2 shows a state where the dump truck starts to decelerate near the unloading area and stops in the unloading area. The engine rotational speed N1 varies minutely as shown in the characteristic line 17 for speed adjustment, and when the engine rotational speed N1 becomes less than the predetermined engine rotational speed Nis, the hydraulic drive fan 7 is controlled by the fan idling rotational speed control as shown in FIG. 6. Thereby, the pump capacity q1 of the hydraulic pump 2, as shown in the characteristic line 18, transfers to the pump capacity q1*i* at the fan idling rotational speed time. In addition, the opening area A1 of the flow amount control valve 8 is controlled to the opening area A1*i* at the fan idling rotational speed time and the flow amount of the pressurized oil to be supplied to the hydraulic motor 6 through the flow amount control valve 8 is controlled to the flow amount Q2*i* at the fan idling rotational speed time. Thereby, the rotational speed N2 of the hydraulic motor 6 for driving the hydraulic drive fan 7 transfers, as shown in the characteristic line 19, to the fan idling rotational speed. As a result, the flow amount Q2 of the pressurized oil to be supplied to the hydraulic motor 6 can be suppressed from minutely varying following the variation in the engine rotational speed N1 and the rotational speed of the hydraulic drive fan 7 can be suppressed from abruptly varying.

Here, the pump capacity q1 of the hydraulic pump 2 keeps the pump capacity q1*i* at the fan idling rotational speed time, but since the engine rotational speed N1 varies, the delivery flow amount Q1 of the hydraulic pump 2 varies. However, the opening area A1 of the flow amount control valve 8 is controlled to the opening area A1*i* at the fan idling rotational speed time. Therefore, the flow amount Q2 of the pressurized oil to be supplied to the hydraulic motor 6 through the flow amount control valve can be kept as the flow amount Q2*i* at the fan idling rotational speed time to suppress the variation in the rotational speed of the hydraulic drive fan 7.

Next, at time t2, the dump truck stops at the unloading area, and for performing the unloading work, the working machine 12 operates in response to an operation of the working machine operation device 13. Thereby, the pressurized oil is delivered to the working machine 12 from the hydraulic pump 2, and the engine rotational speed N1 minutely varies as shown in the characteristic line 17 in accordance with the operation state of the working machine 12. At this time, a signal in accordance with the operation amount of the working machine operation device 13 is inputted to the controller 16 to control the hydraulic drive fan 7 by the fan rotation stopping control as shown in FIG. 7. Thereby, the opening area A1 of the flow amount control valve 8 transfers to 0, and the hydraulic oil in the tank 3 is supplied through a check valve 9 to the inflow port of the hydraulic motor 6. Accordingly, the hydraulic motor 6 rotates by inertia, and the rotational speed N2 of the hydraulic motor 6 is gradually reduced.

In addition, the dump truck performs the unloading work and the delivery flow amount Q1 of the hydraulic pump 2 increases or decreases in accordance with the operation state of the working machine 12 during the period from time t2 to time t3. Therefore, the engine rotational speed N1 minutely varies as shown in the characteristic line 17. At this time, since the opening area A1 of the flow amount control valve 8 is kept as 0, after the rotation of the hydraulic motor 6 by inertia is stopped, the rotational speed N2 of the hydraulic motor 6 becomes equal to 0 as shown in the characteristic line 19. As a result, it is possible to suppress the variation in the rotational speed of the hydraulic drive fan 7 during a period when the working machine 12 is operating.

Next, at time t3, the dump truck terminates the unloading work and starts the travel toward the loading area from the unloading area, for example. At this time, when the speed of dump truck increases, the engine rotational speed N1 varies as shown in the characteristic line 17 and the hydraulic drive fan 7 is controlled by the fan idling rotational speed control as shown in FIG. 6. At this time, the pump capacity q1 of the hydraulic pump 2 is set to the minimum value as shown in the characteristic line 18, which thereafter, transfers to the pump capacity q1*i* at the fan idling rotational speed time with a predetermined change amount per a predetermined unit time. In addition, the opening area A1 of the flow amount control valve 8 is controlled to the opening area A1*i* at the fan idling rotational speed time, and the flow amount Q2 of the pressurized oil to be supplied to the hydraulic motor 6 becomes equal to the flow amount Q2*i* at the fan idling rotational speed time.

In addition, during the period from time t3 to time t4, since the dump truck adjusts the traveling speed, the engine rotational speed N1 varies as shown in the characteristic line 17. At this time, the pump capacity q1 of the hydraulic pump 2 keeps the pump capacity q1*i* at the fan idling rotational speed time, but since the engine rotational speed N1 varies, the delivery flow amount Q1 of the hydraulic pump 2 varies. However, the opening area A1 of the flow amount control valve 8 is controlled to the opening area A1*i* at the fan idling rotational speed time. Therefore, the flow amount Q2 of the pressurized oil to be supplied to the hydraulic motor 6 through the flow amount control valve 8 can keep the flow amount Q2*i* at the fan idling rotational speed time to suppress the variation in the rotational speed of the hydraulic drive fan 7.

Next, the traveling speed of the dump truck increases, and in time t4, the engine rotational speed N1 reaches the predetermined engine rotational speed Nis. At this time, it is required to distinguish a case where the dump truck is performing the speed adjustment near the unloading area over a case where the dump truck is performing the unloading work using the working machine 12. Therefore, the fan idling rotational speed control is executed during a period where the engine rotational speed N1 keeps the value of the predetermined engine rotational speed N1*s* or more to time t5 when a constant time ts or more elapses from time t4.

In addition, when the engine rotational speed N1 keeps the value of the predetermined engine rotational speed N1*s* or more for the constant time ts or more in time t5, the hydraulic drive fan 7 is controlled by the fan predetermined rotational speed control as shown in FIG. 5. Thereby, the opening area A1 of the flow amount control valve 8 is maximized with a predetermined change amount per a predetermined unit time. The pump capacity q1 of the hydraulic pump 2 becomes, as shown in the characteristic line 18, equal to the pump capacity q1*p* at the fan predetermined rotational speed time with the predetermined change amount per the predetermined unit time. Thereby, the rotational speed N2 of the hydraulic motor 6 gradually transfers to the fan predetermined rotational speed from time t5 as shown in the characteristic line 19. As a result, the rotational speed of the hydraulic drive fan 7 can be suppressed from abruptly varying following the variation in the engine rotational speed N1 to suppress variation in the rotation of the hydraulic drive fan 7.

Next, during a period from time t5 to time t6, for example, the dump truck is traveling toward the loading area, and the engine rotational speed N1 keeps the value of the predetermined engine rotational speed N1*s* or more over the constant time is or more. The fan predetermined rotational speed control continues to be executed during the period from time t5 to time t6. In addition, in time t6, the dump truck transfers to the deceleration travel, and when the engine rotational speed N1 becomes less than the predetermined engine rotational speed Nis, the hydraulic drive fan 7 is, as similar to time t1 as described before, controlled by the fan idling rotational speed control.

In this way, the hydraulic drive fan control device 1 according to the first embodiment, even when the engine rotational speed N1 varies at the working time of the dump truck, can set the rotational speed N2 of the hydraulic motor 6 to three kinds of the fan predetermined rotational speed, the fan idling rotational speed and 0. Thereby, the pump capacity q1 of the hydraulic pump 2 is controlled, making it possible to suppress the variation in the delivery flow amount Q1 of the hydraulic pump 2. In addition, the opening area A1 of the flow amount control valve 8 is controlled, making it possible to control the flow amount Q2 and the pressure P2 of the pressurized oil to be supplied to the hydraulic motor 6. Accordingly, the rotational speed N2 of the hydraulic motor 6 can be suppressed from minutely varying following the variation in the engine rotational speed N1. As a result, it is possible to suppress the generation of the peak pressure or the hunching in the hydraulic circuit to extend lifetime of the hydraulic equipment devices such as the hydraulic motor 6, the fan pipe line 5 and the like configuring the hydraulic circuit.

In addition, the hydraulic drive fan control device 1 makes the pump capacity q1 of the hydraulic pump 2 equal to the minimum pump capacity q1*m* once at the time of rotating the hydraulic drive fan 7 from the stopped state, and thereafter, the minimum pump capacity q1*m* is increased to the pump capacity q1*p* at the fan predetermined rotational speed time or the pump capacity q1*i* at the fan idling rotational speed time. As a result, the rotation of the hydraulic drive fan 7 can be suppressed from abruptly varying to suppress the generation of the peak pressure or the hunching in the hydraulic circuit.

Further, when the hydraulic drive fan control device 1 changes the rotational speed of the hydraulic drive fan 7, the hydraulic drive fan control device 1 outputs the valve control signal to the flow amount control valve 8 with a predetermined change amount per a predetermined unit time and outputs the pump control signal to the hydraulic pump 2 with a predetermined change amount per a predetermined unit time. Thereby, the flow amount of the pressurized oil to be supplied to the hydraulic motor 6 can be gradually increased. As a result, the rotation of the hydraulic drive fan 7 can be suppressed from abruptly varying to suppress the generation of the peak pressure or the hunching in the hydraulic circuit.

Next, FIG. 9 to FIG. 13 show a second embodiment of the present invention, and the second embodiment is characterized in that the relief valve 10 according to the first embodiment is formed of a variable relief valve. It should be noted that in the second embodiment, components identical to those in the first embodiment are referred to as identical reference numerals, and the explanation is omitted.

Figure 9:
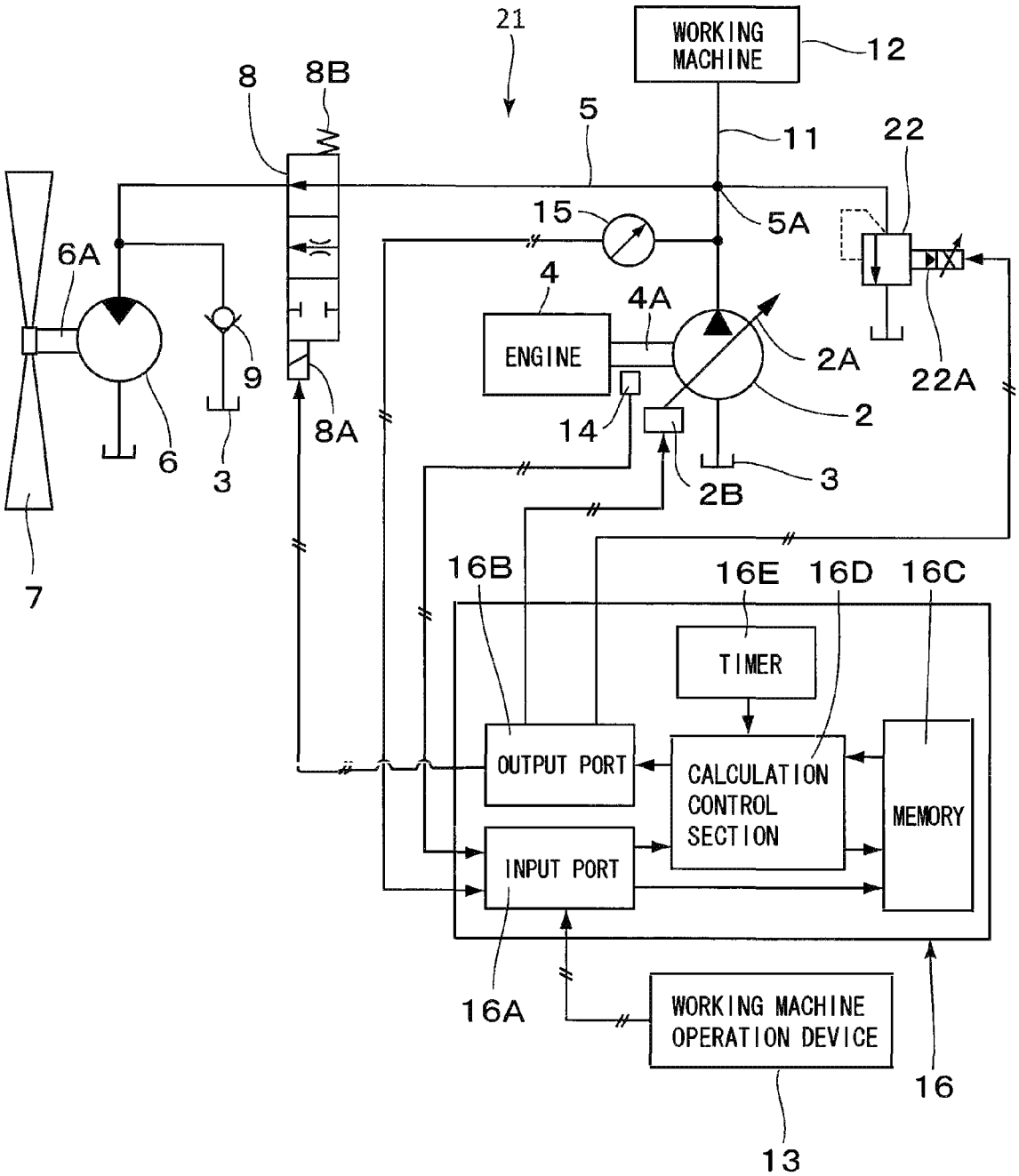
FIG. 9 is a configuration diagram of a hydraulic drive fan control device according to a second embodiment.

A hydraulic drive fan control device 21 as shown in FIG. 9 is, as similar to the first embodiment, configured of the hydraulic pump 2, the hydraulic motor 6, the hydraulic drive fan 7, the flow amount control valve 8, the rotational speed detector 14, the pressure detector 15, the controller 16 and the like. However, the hydraulic drive fan control device 21 differs in a point where a variable relief valve 22 is disposed in the halfway of the fan pipe line 5, from the hydraulic drive fan control device 1 according to the first embodiment.

The variable relief valve 22 is disposed in the halfway of the fan pipe line 5 and sets a delivery pressure of the pressurized oil to be delivered to the fan pipe line 5 from the hydraulic pump 2 and discharges an extra pressure to the tank 3. The variable relief valve 22 has a pressure control part 22A, and a relief pressure Pr1 (MPa) of the variable relief valve 22 changes in accordance with a relief pressure control amount Cr (A) to be outputted to the pressure control part 22A from the controller 16. The relief pressure control amount Cr (A) is supplied to the pressure control part 22A as an instruction current (a control signal) from the controller 16.

Figure 10:
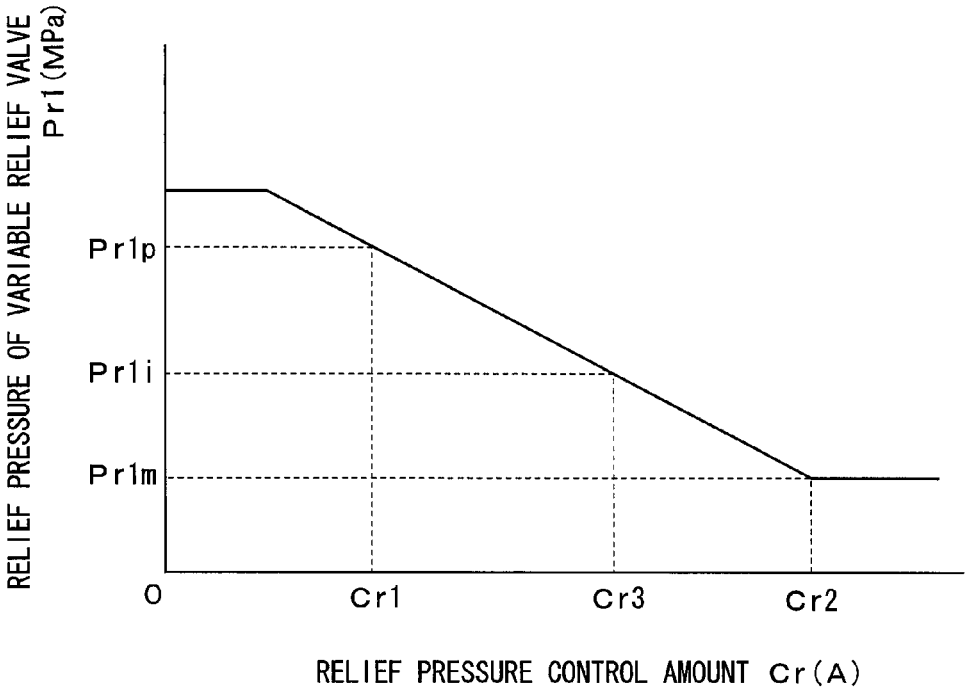
FIG. 10 is a characteristic line diagram showing a relation between a relief pressure control amount to be inputted to a pressure control part in a variable relief valve and a relief pressure of the variable relief valve.

Here, a relation of the relief pressure control amount Cr (A) to be inputted to the pressure control part 22A from the controller 16 and the relief pressure Pr1 (MPa) of the variable relief valve 22 is made as shown in a characteristic line diagram in FIG. 10. That is, in a case where the relief pressure control amount Cr becomes equal to a first relief pressure control amount Cr1, the relief pressure Pr1 becomes equal to the relief pressure Pr1*p* at the fan predetermined rotational speed time. In a case where the relief pressure control amount Cr becomes equal to a second relief pressure control amount Cr2, the relief pressure Pr1 becomes equal to the minimum relief pressure Pr1*m*. In a case where the relief pressure control amount Cr becomes equal to a third relief pressure control amount Cr3, the relief pressure Pr1 becomes equal to the relief pressure Pr1*i* at the fan idling rotational speed time.

The hydraulic drive fan control device 21 according to the second embodiment has the configuration as described above, and next, an explanation will be made of the fan predetermined rotational speed control by the controller 16 with reference to FIG. 11.

Figure 11:
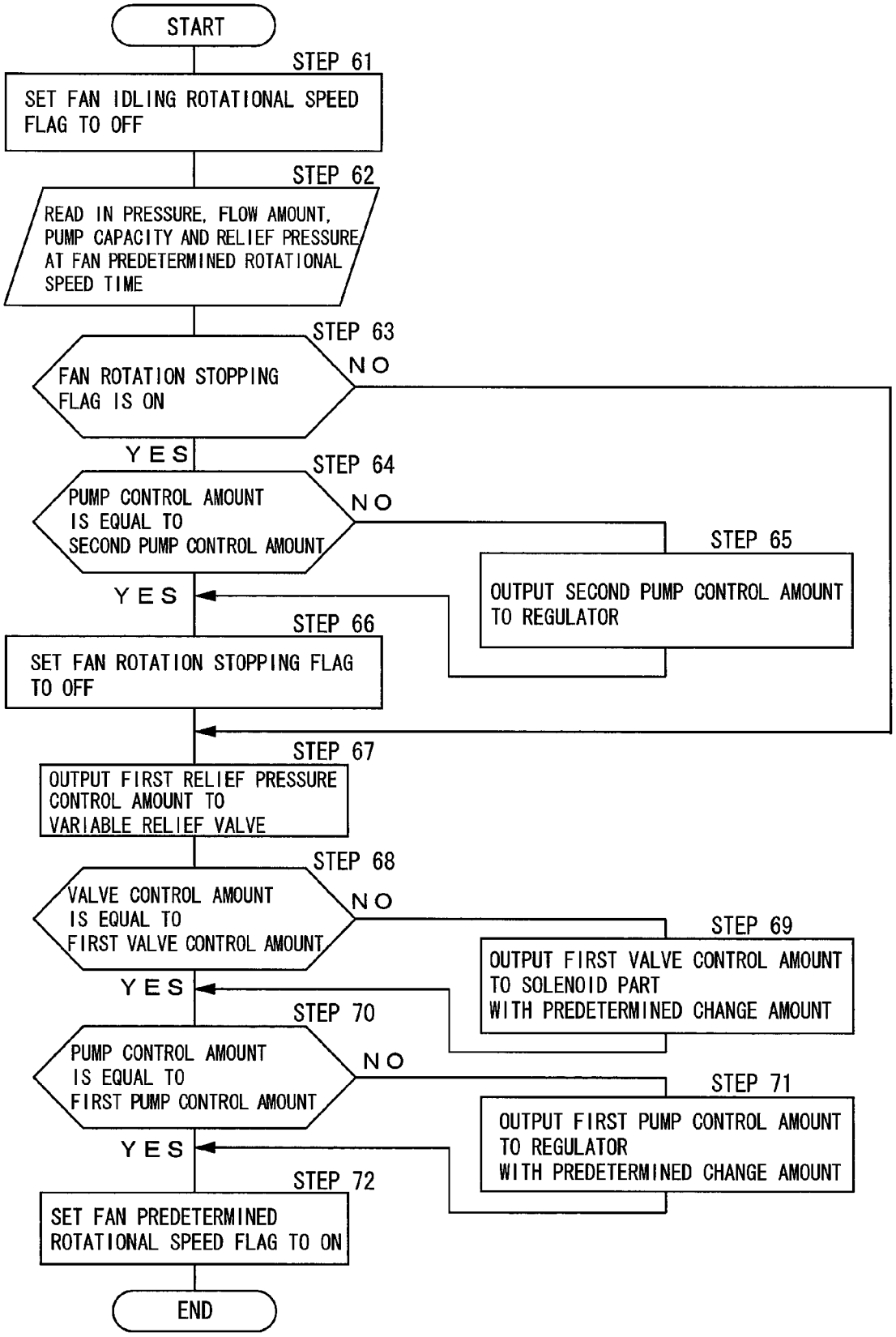
FIG. 11 is a flow chart showing a processing content of the fan predetermined rotational speed control.

In the fan predetermined rotational speed control as shown in FIG. 11, the calculation control section 16D sets the fan idling rotational speed flag to OFF in step 61. Next, in step 62, the calculation control section 16D reads in the pressure P2 of the pressurized oil to be supplied to the hydraulic motor 6, the flow amount Q2 of the pressurized oil passing through the flow amount control valve 8, the pump capacity q1*p* of the hydraulic pump 2 and the relief pressure Pr1*p* of the variable relief valve 22 at the fan predetermined rotational speed time from the memory 16C.

Next, in step 63, the calculation control section 16D determines whether or not the fan rotation stopping flag is ON. In a case where "NO" is determined, the process goes to step 67, and in a case where "YES" is determined in step 63, the process goes to step 64. In step 64, the calculation control section 16D determines whether or not the pump control amount Cp to be outputted to the regulator 2B of the hydraulic pump 2 is equal to the second pump control amount Cp2. In a case where "NO" is determined in step 64, in step 65, the calculation control section 16D outputs the second pump control amount Cp2 to the regulator 2B of the hydraulic pump 2.

In a case where "YES" is determined in step 64, in step 66, the calculation control section 16D sets the fan rotation stopping flag to OFF, and thereafter, the process goes to step 67. In step 67, the calculation control section 16D outputs the first relief pressure control amount Cr1 to the pressure control part 22A of the variable relief valve 22 and defines the relief pressure Pr1 of the variable relief valve 22 as the relief pressure Pr1*p* at the fan predetermined rotational speed time.

Next, in step 68, the calculation control section 16D determines whether or not the valve control amount Cv to be outputted to the solenoid part 8A of the flow amount control valve 8 is equal to the first valve control amount Cv1. In a case where "NO" is determined in step 68, in step 69, the calculation control section 16D outputs the first valve control amount Cv1 to the solenoid part 8A of the flow amount control valve 8 with a predetermined change amount per a predetermined unit time. Meanwhile, in a case where "YES" is determined in step 68, in step 70, the calculation control section 16D determines whether or not the pump control amount Cp to be outputted to the regulator 2B of the hydraulic pump 2 is equal to the first pump control amount Cp1.

In a case where "NO" is determined in step 70, in step 71, the calculation control section 16D outputs the first pump control amount Cp1 to the regulator 2B of the hydraulic pump 2 with a predetermined change amount per a predetermined unit time. In a case where "YES" is determined in step 70, since the pump capacity q1 of the hydraulic pump 2 becomes equal to the pump capacity q1*p* at the fan predetermined rotational speed time, the hydraulic motor 6 can rotate the hydraulic drive fan 7 at the fan predetermined rotational speed. In addition, the calculation control section 16D sets the fan predetermined rotational speed flag to ON in step 72, and thereafter, ends the control processing.

Next, an explanation will be made of the fan idling rotational speed control by the controller 16 with reference to FIG. 12.

Figure 12:
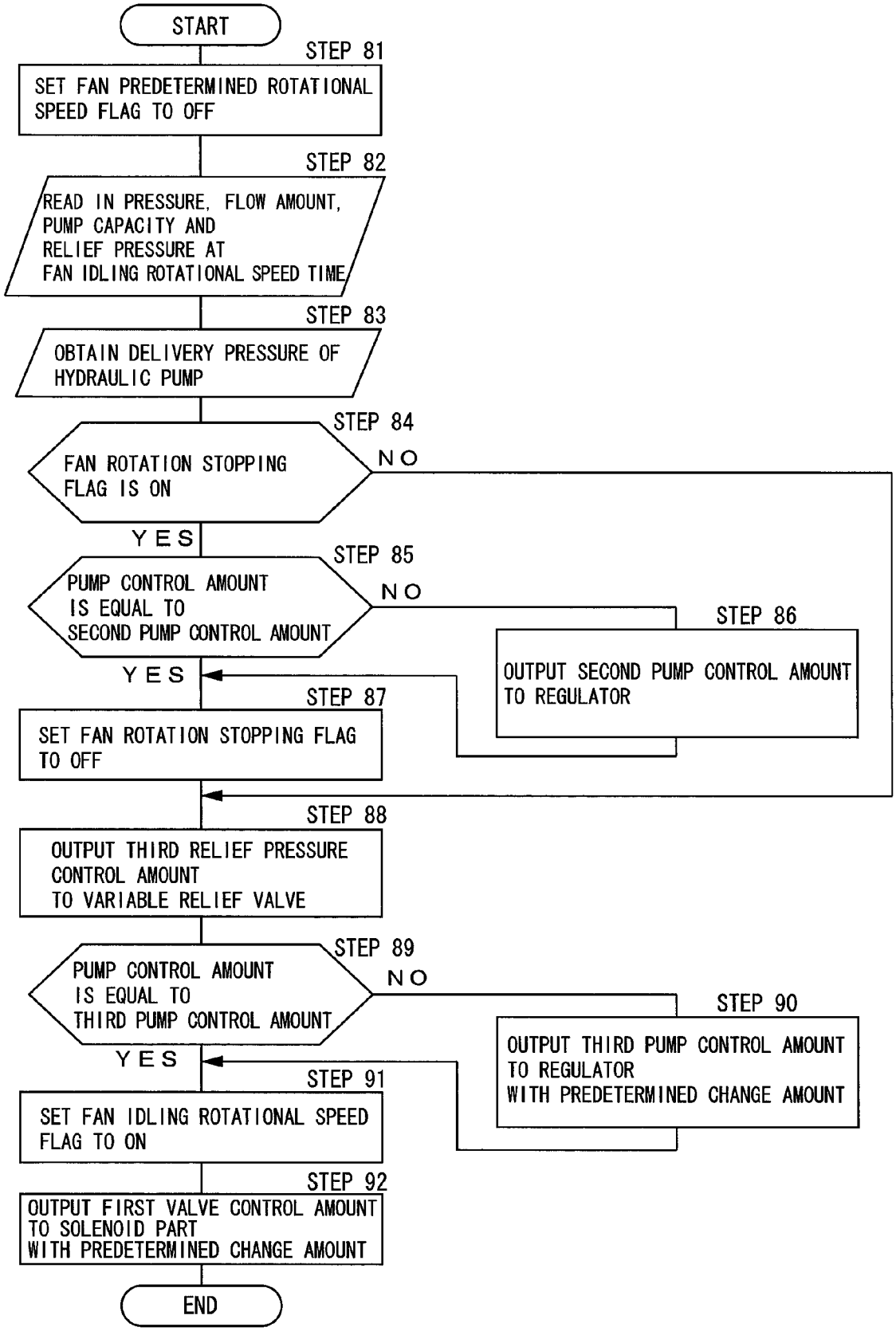
FIG. 12 is a flow chart showing a processing content of the fan idling rotational speed control.

In the fan idling rotational speed control as shown in FIG. 12, the calculation control section 16D sets the fan predetermined rotational speed flag to OFF in step 81. Next, in step 82, the calculation control section 16D reads in the pressure P2 of the pressurized oil to be supplied to the hydraulic motor 6, the flow amount Q2 of the pressurized oil passing through the flow amount control valve 8, the pump capacity q1*i* of the hydraulic pump 2 and the relief pressure Pr1*i* of the variable relief valve 22 at the fan idling rotational speed time from the memory 16C.

Next, in step 83, the calculation control section 16D obtains the delivery pressure P1 of the hydraulic pump 2 based upon the detection signal from the pressure detector 15. In subsequent step 84, the calculation control section 16D determines whether or not the fan rotation stopping flag is ON. In a case where "NO" is determined, the process goes to step 88, and in a case where "YES" is determined in step 84, the process goes to step 85. In step 85, the calculation control section 16D determines whether or not the pump control amount Cp to be outputted to the regulator 2B of the hydraulic pump 2 is equal to the second pump control amount Cp2. In a case where "NO" is determined in step 85, in step 86, the calculation control section 16D outputs the second pump control amount Cp2 to the regulator 2B of the hydraulic pump 2.

In a case where "YES" is determined in step 85, in step 87, the calculation control section 16D sets the fan rotation stopping flag to OFF, and thereafter, the process goes to step 88. In step 88, the calculation control section 16D outputs the third relief pressure control amount Cr3 to the pressure control part 22A of the variable relief valve 22 and defines the relief pressure Pr1 of the variable relief valve 22 as the relief pressure Pr1*i* at the fan idling rotational speed time. As a result, the delivery pressure of the pressurized oil to be delivered to the fan pipe line 5 from the hydraulic pump 2 is limited to the delivery pressure at the fan idling rotational speed time.

Next, in step 89, the calculation control section 16D determines whether or not the pump control amount Cp to be outputted to the regulator 2B of the hydraulic pump 2 is equal to the third pump control amount Cp3 for making the pump capacity of the hydraulic pump 2 the pump capacity q1*i* at the fan idling rotational speed time. In a case where "NO" is determined in step 89, in step 90, the calculation control section 16D outputs the third pump control amount Cp3 to the regulator 2B of the hydraulic pump 2 with a predetermined change amount per a predetermined unit time.

In a case where "YES" is determined in step 89, in step 91, the calculation control section 16D sets the fan idling rotational speed flag to ON, and then, the process goes to step 92. In step 92, the calculation control section 16D outputs the first valve control amount Cv1 to the solenoid part 8A of the flow amount control valve 8 with a predetermined change amount per a predetermined unit time to maximize the opening area A1 of the flow amount control valve 8. At this time, the pressure in the fan pipe line 5 is reduced to the relief pressure Pr1*i* at the fan idling rotational speed time by the variable relief valve 22. Therefore, the pressure P2 of the pressurized oil to be supplied to the hydraulic motor 6 through the flow amount control valve 8 the opening area A1 of which is maximized, is made to the pressure P2*i* at the fan idling rotational speed time, and the hydraulic motor 6 can rotate the hydraulic drive fan 7 at the fan idling rotational speed.

Next, an explanation will be made of the fan rotation stopping control by the controller 16 with reference to FIG. 13.

Figure 13:
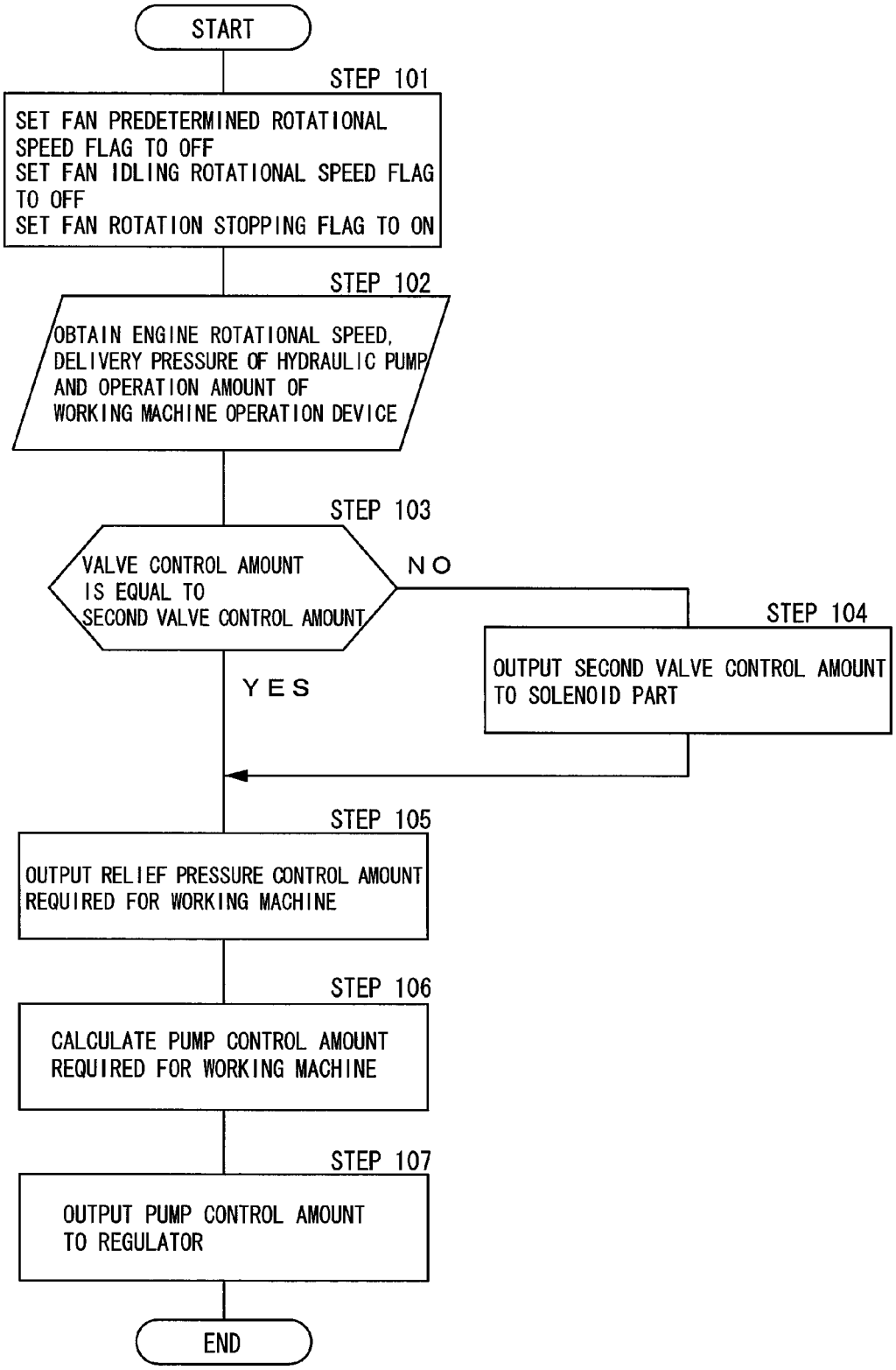
FIG. 13 is a flow chart showing a processing content of the fan rotation stopping control.

In the fan rotation stopping control as shown in FIG. 13, in step 101, the calculation control section 16D sets the fan predetermined rotational speed flag and the fan idling rotational speed flag to OFF and sets the fan rotation stopping flag to ON, and then, the process goes to step 102. In step 102, the calculation control section 16D obtains the engine rotational speed N1 detected by the rotational speed detector 14, the delivery pressure P1 of the hydraulic pump 2 detected by the pressure detector 15 and the operation amount of the working machine operation device 13.

In subsequent step 103, the calculation control section 16D determines whether or not the valve control amount Cv to be outputted to the solenoid part 8A of the flow amount control valve 8 is equal to the second valve control amount Cv2. Ina case where "NO" is determined in step 103, in step 104, the calculation control section 16D outputs the second valve control amount Cv2 to the solenoid part 8A of the flow amount control valve 8. Thereby, the opening area A1 of the flow amount control valve 8 becomes equal to 0, and the rotational speed N2 of the hydraulic motor 6 transfers to 0.

In a case where "YES" is determined in step 103, in step 105, the calculation control section 16D outputs the predetermined relief pressure control amount Cr to the pressure control part 22A of the variable relief valve 22. As a result, the relief pressure Pr1 of the variable relief valve 22 is set to a pressure required for the operation of the working machine 12.

In subsequent step 106, the calculation control section 16D calculates the pump control amount Cp required for the operation of the working machine 12 based upon the engine rotational speed N1, the delivery pressure P1 of the hydraulic pump 2 and the operation amount of the working machine operation device 13, which are obtained in step 102. In step 107, the calculation control section 16D outputs the calculated pump control amount Cp to the regulator 2B of the hydraulic pump 2 to make the pump capacity of the hydraulic pump 2 the pump capacity q1 required for the operation of the working machine 12. Thereby, the working machine 12 can operate by the pressurized oil to be delivered from the hydraulic pump 2.

In this way, the hydraulic drive fan control device 21 according to the second embodiment, even when the engine rotational speed N1 varies depending upon the working condition of the dump truck, can set, as similar to the first embodiment, the rotational speed N2 of the hydraulic motor 6 to three kinds of the fan predetermined rotational speed, the fan idling rotational speed and 0. Thereby, the rotational speed N2 of the hydraulic motor 6 can be suppressed from minutely varying following the variation in the engine rotational speed N1.

Further, the hydraulic drive fan control device 21 can optionally adjust the maximum pressure in the fan pipe line 5 by the variable relief valve 22. Accordingly, when the rotational speed N2 of the hydraulic motor 6 is controlled to three kinds of the fan predetermined rotational speed, the fan idling rotational speed and 0, it is possible to set the maximum pressure in the fan pipe line 5 suitable for each of the rotational speeds.

Next, FIG. 14 to FIG. 17 show a third embodiment of the present invention, and the third embodiment is characterized in that the fan idling rotational speed control is not executed to the hydraulic drive fan and two kinds of the controls composed of the fan predetermined rotational speed control and the fan rotation stopping control are executed thereto. It should be noted that the configuration of the hydraulic drive fan control device according to the third embodiment is the same as that of the hydraulic drive fan control device 1 as shown in FIG. 1.

Figure 14:
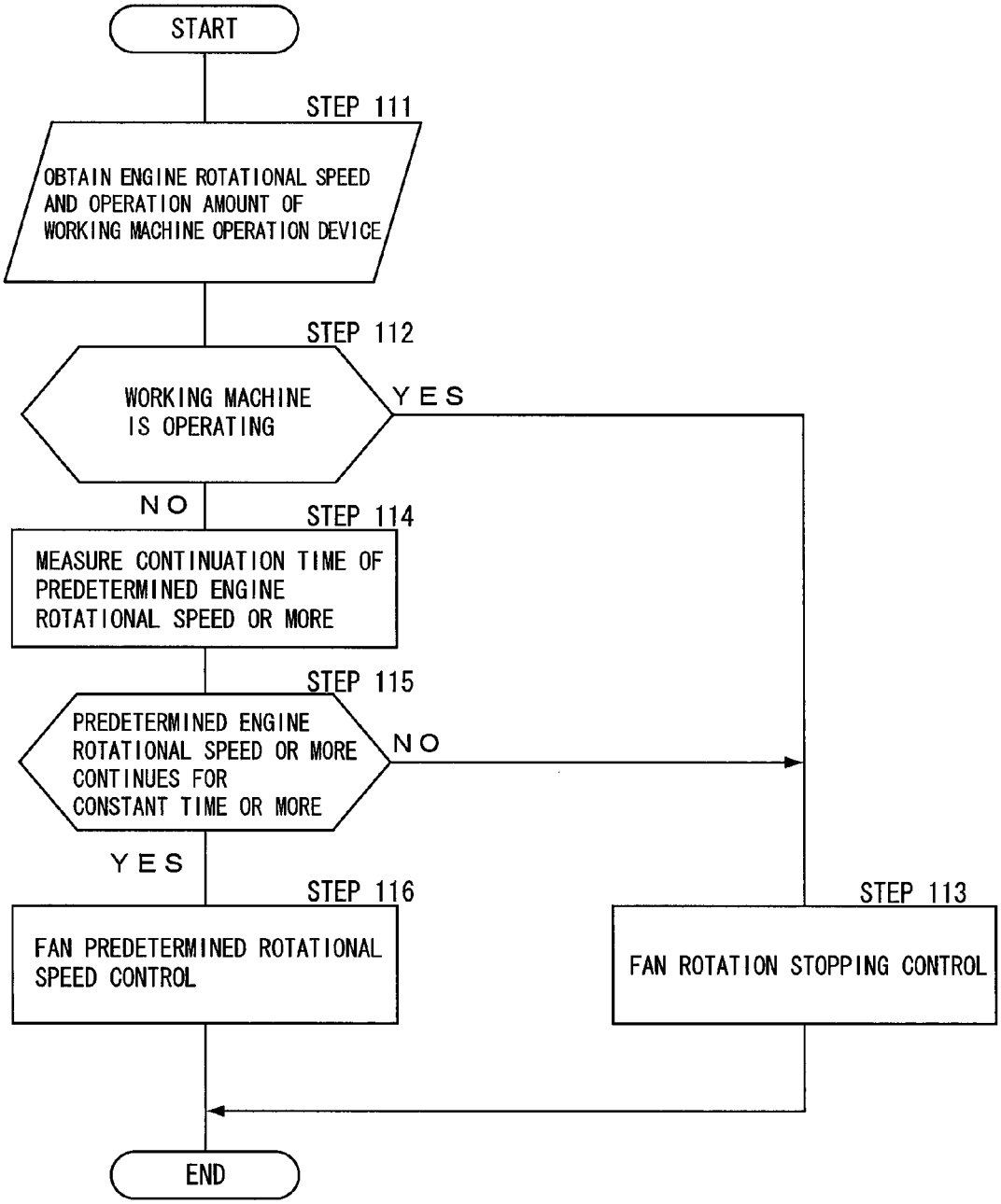
FIG. 14 is a flow chart showing determination processing of fan predetermined rotational speed control and fan rotation stopping control according to a third embodiment.

The controller 16 determines which of the fan predetermined rotational speed control and the fan rotation stopping control should be applied to the hydraulic drive fan 7 by the determination processing as shown in FIG. 14.

Figure 16:
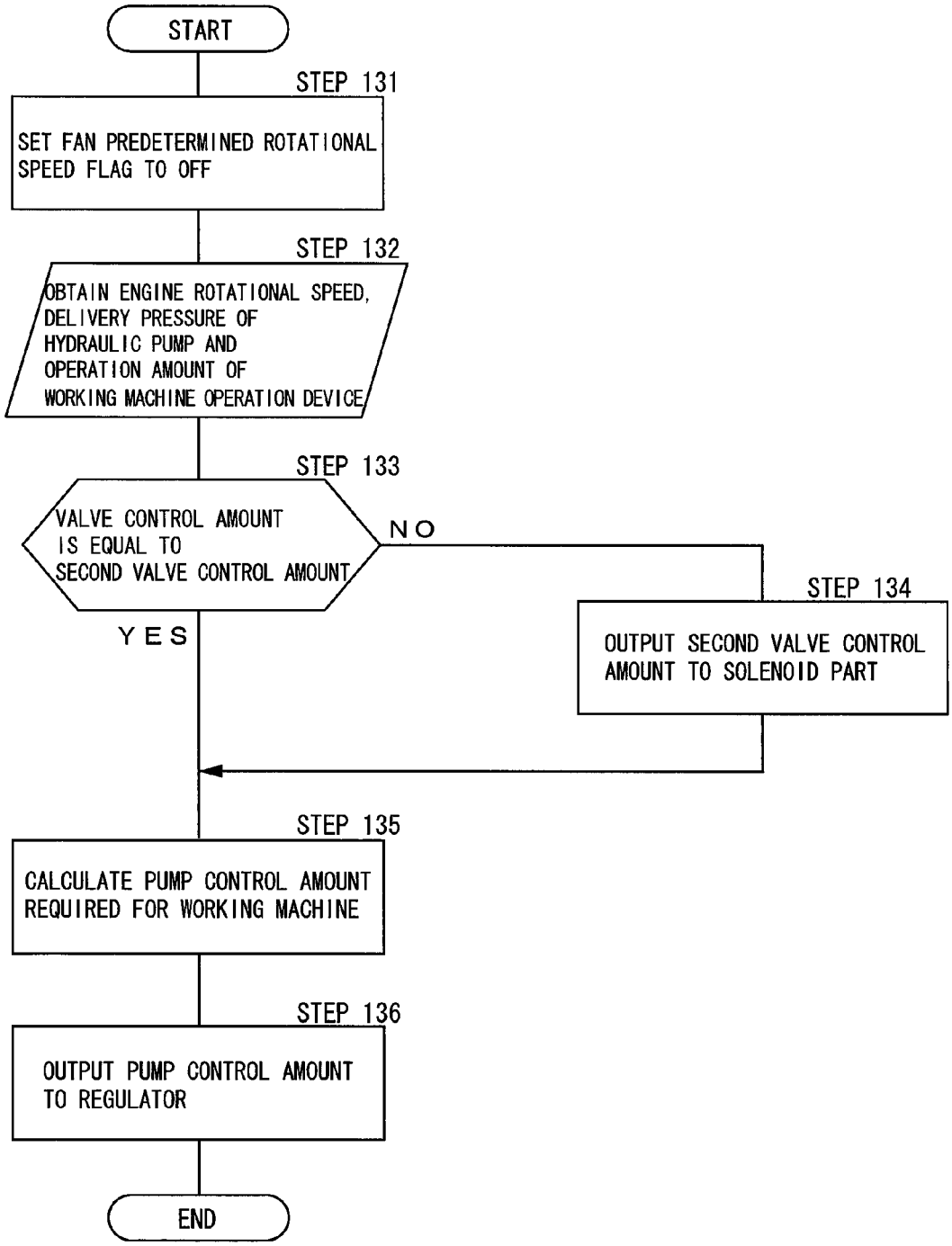
FIG. 16 is a flow chart showing a processing content of the fan rotation stopping control.

In step 111, the controller 16 obtains the engine rotational speed N1 detected by the rotational speed detector 14 and the operation amount of the working machine operation device 13, which are stored in the memory 16C. Next, in step 112, the calculation control section 16D determines whether or not the working machine 12 is operated by the working machine operation device 13. In a case where "YES" is determined in step 112, the process goes to step 113, wherein the fan rotation stopping control as shown in FIG. 16 is executed. In a case where "NO" is determined in step 112, the calculation control section 16D measures a continuation time during which the engine rotational speed N1 becomes equal to or more than the predetermined engine rotational speed N1*s* in step 114.

Next, in step 115, the calculation control section 16D determines whether or not the engine rotational speed N1 is kept as the value equal to or more than the predetermined engine rotational speed N1*s* for a constant time or more. In a case where "NO" is determined in step 115, the process goes to step 113, wherein the fan rotation stopping control as shown in FIG. 16 is executed. Meanwhile, in a case where "YES" is determined in step 115, the process goes to step 116, wherein the calculation control section 16D executes the fan predetermined rotational speed control as shown in FIG. 15.

In this way, according to the third embodiment, the controller 16 executes the fan rotation stopping control in a case where the working machine 12 is operated and in a case where the engine rotational speed N1 is not kept as the value equal to or more than the predetermined engine rotational speed N1*s* for a constant time or more. In addition, the controller 16 executes the fan predetermined rotational speed control in a case where the engine rotational speed N1 is kept as the value equal to or more than the predetermined engine rotational speed N1*s* for the constant time or more.

Next, an explanation will be made of the fan predetermined rotational speed control by the controller 16 with reference to FIG. 15.

Figure 15:
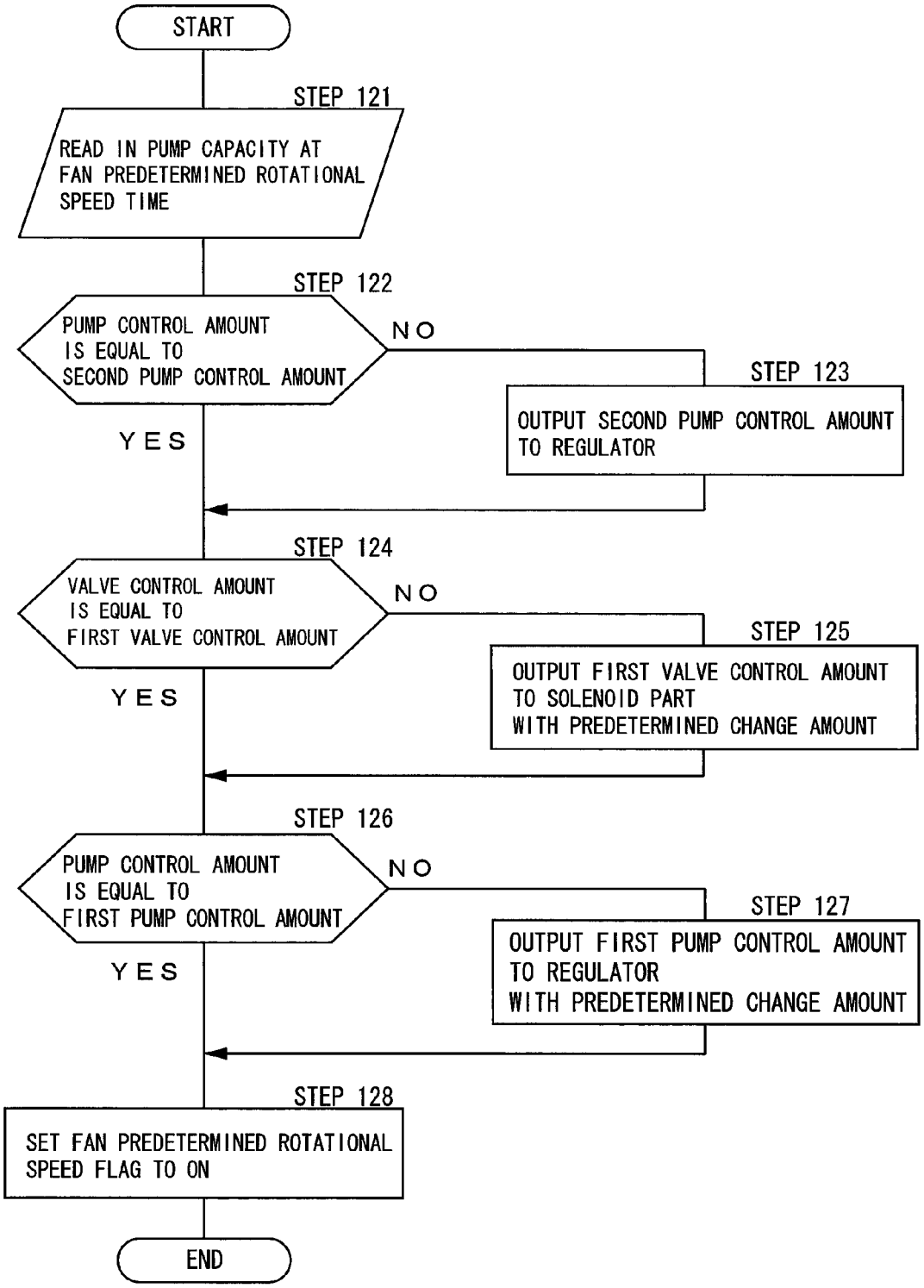
FIG. 15 is a flow chart showing a processing content of the fan predetermined rotational speed control.

In the fan predetermined rotational speed control as shown in FIG. 15, in step 121, the calculation control section 16D reads in the pump capacity q1 of the hydraulic pump 2 at the fan predetermined rotational speed time from the memory 16C, and the process goes to step 122. In step 122, the calculation control section 16D determines whether or not the pump control amount Cp to be outputted to the regulator 2B of the hydraulic pump 2 is equal to the second pump control amount Cp2. In a case where "NO" is determined in step 122, in step 123, the calculation control section 16D outputs the second pump control amount Cp2 to the regulator 2B of the hydraulic pump 2. In a case where "YES" is determined in step 122, in step 124, the calculation control section 16D determines whether or not the valve control amount Cv to be outputted to the solenoid part 8A in the flow amount control valve 8 is equal to the first valve control amount Cv1.

In a case where "NO" is determined in step 124, in step 125, the calculation control section 16D outputs the first valve control amount Cv1 to the solenoid part 8A with a predetermined change amount per a predetermined unit time. In a case where "YES" is determined in step 124, in step 126, the calculation control section 16D determines whether or not the pump control amount Cp to be outputted to the regulator 2B of the hydraulic pump 2 is equal to the first pump control amount Cp1.

In a case where "NO" is determined in step 126, in step 127, the calculation control section 16D outputs the first pump control amount Cp1 (A) to the regulator 2B of the hydraulic pump 2 with a predetermined change amount per a predetermined unit time. Meanwhile, in a case where "YES" is determined in step 126, since the pump capacity q1 of the hydraulic pump 2 becomes equal to the pump capacity q1*p* at the fan predetermined rotational speed time, the hydraulic motor 6 can rotate the hydraulic drive fan 7 at the fan predetermined rotational speed. In addition, the calculation control section 16D sets the fan predetermined rotational speed flag to ON in step 128, and thereafter, ends the control processing.

Next, an explanation will be made of the fan rotation stopping control by the controller 16 with reference to FIG. 16.

In the fan rotation stopping control as shown in FIG. 16, the calculation control section 16D sets the fan predetermined rotational speed flag to OFF in step 131, and thereafter, the process goes to step 132. In step 132, the calculation control section 16D obtains the engine rotational speed N1 detected by the rotational speed detector 14, the delivery pressure P1 of the hydraulic pump 2 detected by the pressure detector 15 and the operation amount of the working machine operation device 13.

In subsequent step 133, the calculation control section 16D determines whether or not the valve control amount Cv to be outputted to the solenoid part 8A of the flow amount control valve 8 is equal to the second valve control amount Cv2. Ina case where "NO" is determined in step 133, in step 134, the calculation control section 16D outputs the second valve control amount Cv2 to the solenoid part 8A. Thereby, the opening area A1 of the flow amount control valve 8 becomes equal to 0, and the rotational speed N2 of the hydraulic motor 6 transfers to 0.

Meanwhile, in a case where "YES" is determined in step 133, in step 135, the calculation control section 16D calculates the pump control amount Cp required for the operation of the working machine 12. In addition, in step 136, the calculation control section 16D outputs the calculated pump control amount Cp to the regulator 2B of the hydraulic pump 2. Thereby, the pump capacity of the hydraulic pump 2 is made to the pump capacity q1 required for the operation of the working machine 12, and the working machine 12 can operate by the pressurized oil to be delivered from the hydraulic pump 2.

An explanation will be made of the operational effect of the hydraulic drive fan control device according to the third embodiment with reference to FIG. 17.

Figure 17:
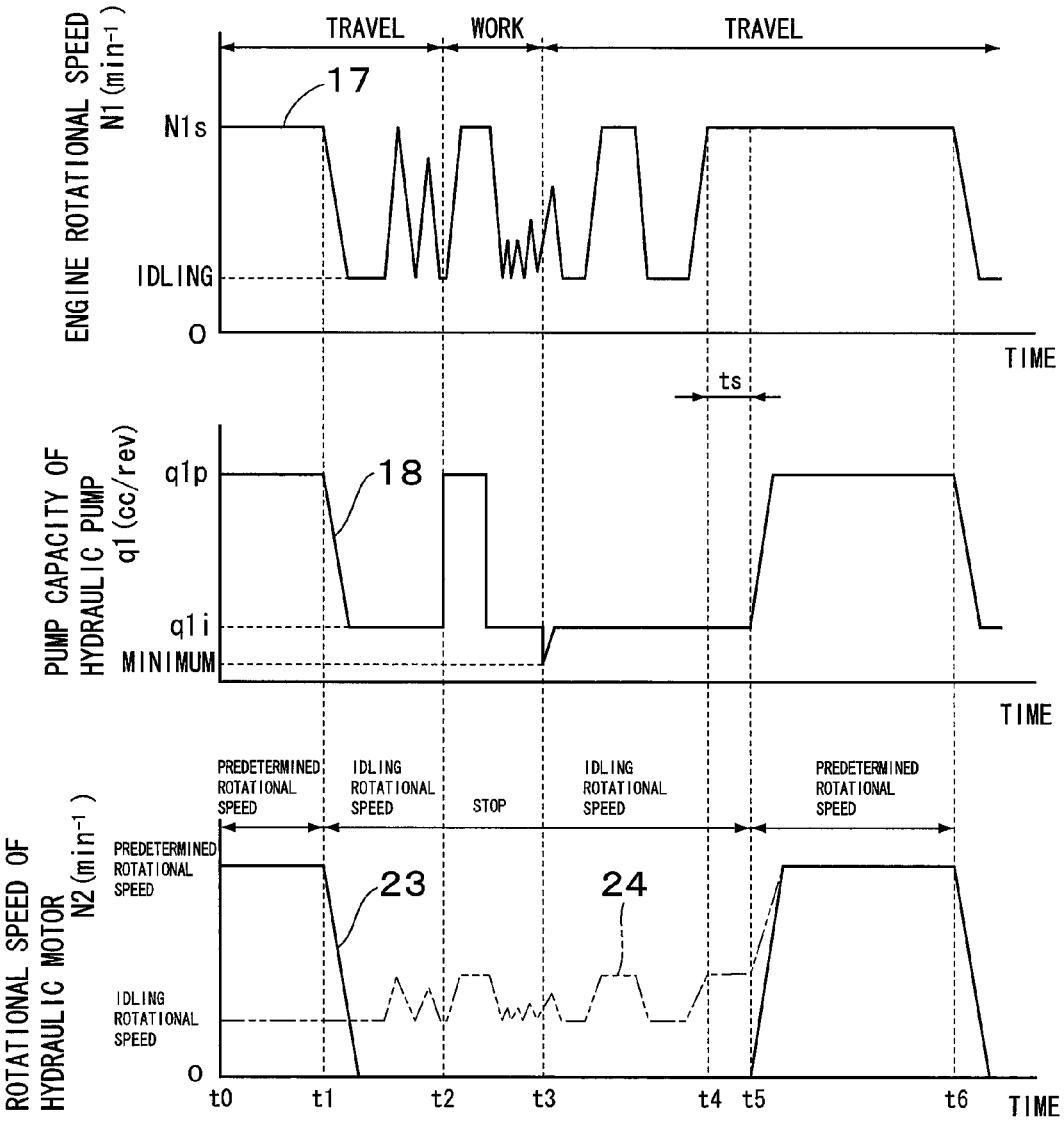
FIG. 17 is a characteristic line diagram showing a temporal relation between an engine rotational speed, a pump capacity of a hydraulic pump and a rotational speed of a hydraulic motor.

In FIG. 17, a period from time t0 to time t1 shows a state where the dump truck is traveling toward an unloading area, for example and a period from time t5 to time t6 shows a state where the dump truck is traveling toward a loading area. During the period from time t0 to time t1 and during the period from time 5 to time 6, the engine rotational speed N1 of the engine 4 is kept, as shown in the characteristic line 17, as the value of the predetermined engine rotational speed N1*s* or more for a constant time is or more. Accordingly, during the period from time t0 to time t1 and during the period from time 5 to time 6, the hydraulic drive fan 7 is controlled by the fan predetermined rotational speed control as shown in FIG. 15. Thereby, during the period from time t0 to time t1 and during the period from time 5 to time 6, the rotational speed N2 of the hydraulic motor 6 for driving the hydraulic drive fan 7 becomes, as shown in a characteristic line 23, equal to the fan predetermined rotational speed.

Next, the period from time t1 to time t2 shows a state where the dump truck decelerates to approach and stop in the unloading area, and the period from time t2 to time t3 shows a state where the dump truck is performing the unloading work. The period from time t3 to time t4 shows a state where the dump truck adjusts the traveling speed to travel from the unloading area to the loading area. During the period from time t1 to time t4, the engine rotational speed N1 minutely varies as shown in the characteristic line 17.

In the third embodiment, the hydraulic drive fan 7 is controlled by the fan rotation stopping control as shown in FIG. 16 during the period from time t1 to time t5. During the period from time t1 to time t5, the opening area A1 of the flow amount control valve 8 becomes equal to 0, and after the rotation of the hydraulic drive fan 7 by inertia is finished, the rotational speed N2 of the hydraulic motor 6 becomes, as shown in the characteristic line 23, equal to 0. As a result, since the hydraulic drive fan 7 is kept in the stopped state, it is possible to suppress the variation in the rotational speed of the hydraulic drive fan 7 following the variation in the engine rotational speed N1.

In this way, according to the third embodiment, even when the engine rotational speed N1 varies as shown in the characteristic line 17 in FIG. 17 at the working time of the dump truck, the rotational speed N2 of the hydraulic motor 6 for rotating the hydraulic drive fan 7 can be, as shown in the characteristic line 23, controlled to two kinds of the fan predetermined rotational speed and 0. Accordingly, the rotational speed N2 of the hydraulic motor 6 can be suppressed from minutely varying as shown in the characteristic line 24 shown in a two-dot chain line in FIG. 17. As a result, it is possible to suppress the generation of the peak pressure or the hunching in the hydraulic circuit to extend a lifetime of the hydraulic equipment devices configuring the hydraulic circuit.

It should be noted that the embodiment takes as an example a case where the pump capacity q1 of the hydraulic pump 2 increases the more as the value of the pump control amount Cp to be inputted to the regulator 2B is smaller. However, the present invention is not limited thereto, but the pump capacity q1 decreases the more as the value of the pump control amount Cp is smaller.

In addition, the embodiment takes as an example a case of using the normally-closed type flow amount control valve 8 that closes when the control signal is not inputted to the solenoid part 8A and opens when the control signal is inputted to the solenoid part 8A. However, the present invention is not limited thereto, but the normally-opened type flow amount control valve 8 may be used.

The embodiment takes as an example a case where at the time of rotating the hydraulic drive fan 7 from the stopped state, the pump capacity q1 of the hydraulic pump 2 is once reduced to the minimum pump capacity q1*m*, and thereafter, is increased to the pump capacity q1*p* at the fan predetermined rotational speed time or the pump capacity q1*i* at the fan idling rotational speed time. However, the present invention is not limited thereto, but may be configured such that the opening area A1 of the flow amount control valve 8 is once minimized, and thereafter, is increased to the maximum opening area at the fan predetermined rotational speed time or the opening area A1*i* at the fan idling rotational speed time.

Further, the embodiment takes as an example a case where the rotation of the hydraulic drive fan 7 is stopped during the period in which the working machine 12 is operating. However, the present invention is not limited thereto, but may be configured such that, for example, in a case where a flow amount and a pressure of the pressurized oil to be supplied to the working machine 12 are secured, the pressurized oil is simultaneously supplied to the hydraulic motor 6, whereby the hydraulic drive fan 7 is rotated at the working time of the working machine 12.

DESCRIPTION OF REFERENCE NUMERALS

1, 21: Hydraulic drive fan control device
2: Hydraulic pump
2B: Regulator (Capacity variable part)
4: Engine (Prime mover)
5: Fan pipe line (Pipe line)
6: Hydraulic motor
7: Hydraulic drive fan
8: Flow amount control valve
8A: Solenoid part (Pilot part)
12: Working machine
13: Working machine operation device
14: Rotational speed detector
15: Pressure detector
16: Controller
16D: Calculation control section

The invention claimed is:

1. A hydraulic drive fan control device comprising:

a variable displacement hydraulic pump that is driven by a prime mover and varies a delivery capacity in response to a control signal to be inputted to a capacity variable part;

a hydraulic motor that is driven by pressurized oil to be delivered from the variable displacement hydraulic pump;

a hydraulic drive fan that is driven by the hydraulic motor;

a flow amount control valve that is disposed in an oil path establishing connection between the variable displacement hydraulic pump and the hydraulic motor and varies a flow amount of the pressurized oil to be delivered to the hydraulic motor in response to a control signal to be inputted to a pilot part;

a rotational speed detector that detects a rotational speed of the prime mover; and a controller that outputs a control signal to the variable displacement hydraulic pump and the flow amount control valve based upon a detection value of the rotational speed detector, wherein the controller includes a calculation control section configured to:

when an output time of a timer continues for a constant time or more in a state where the detection value of the rotational speed detector is kept as a value equal to or more than a predetermined threshold value, output a first valve control signal to the flow amount control valve for rotating the hydraulic drive fan at a first rotational speed;

when the output time of the timer does not continue for the constant time or more in a state where the detection value of the rotational speed detector is kept as the value equal to or more than the threshold value, output a second valve control signal by which the flow amount is minimized, to the flow amount control valve for stopping rotation of the hydraulic drive fan;

when the output time of the timer continues for the constant time or more in a state where the detection value of the rotational speed detector is kept as the value equal to or more than the threshold value, output a first pump control signal to the variable displacement hydraulic pump for rotating the hydraulic drive fan at the first rotational speed; and when the output time of the timer does not continue for the constant time or more in a state where the detection value of the rotational speed detector is kept as the value equal to or more than the threshold value, output a second pump control signal by which the delivery capacity is minimized, to the variable displacement hydraulic pump for stopping the rotation of the hydraulic drive fan, wherein when the output time of the timer does not continue for the constant time or more and is greater than 0 in a state where the detection value of the rotational speed detector is kept as the value equal to or more than the threshold value, the calculation control section outputs a third valve control signal to the flow amount control valve for rotating the hydraulic drive fan at a second rotational speed smaller than the first rotational speed, and when the output time of the timer does not continue for the constant time or more and is greater than 0 in a state where the detection value of the rotational speed detector is kept as the value equal to or more than the threshold value, the calculation control section outputs a third pump control signal to the variable displacement hydraulic pump for rotating the hydraulic drive fan at the second rotational speed smaller than the first rotational speed.

2. The hydraulic drive fan control device according to claim 1, wherein at the time of rotating the hydraulic drive fan from a stopped state, the calculation control section outputs the second valve control signal to the flow amount control valve to minimize the flow amount, and the calculation control section outputs the second pump control signal to the variable displacement hydraulic pump to minimize the delivery capacity.

3. The hydraulic drive fan control device according to claim 1, further comprising:

a working machine that is provided with a hydraulic actuator driven by the pressurized oil to be delivered from the variable displacement hydraulic pump; and a working machine operation device that is disposed for operating the working machine and outputs a detection signal in response to an operation, characterized in that when a detection signal showing that the working machine operation device is operated, is outputted from the working machine operation device, the calculation control section outputs the second valve control signal to the flow amount control valve to minimize the flow amount, and the calculation control section outputs the second pump control signal to the variable displacement hydraulic pump to minimize the delivery capacity.

4. The hydraulic drive fan control device according to claim 1, further comprising:

a pressure detector that detects a delivery pressure from the variable displacement hydraulic pump, characterized in that the calculation control section calculates a value of the third valve control signal to be outputted to the flow amount control valve based upon a detection signal from the pressure detector, and the calculation control section calculates a value of the third pump control signal to be outputted to the variable displacement hydraulic pump based upon the detection signal from the pressure detector.

5. The hydraulic drive fan control device according to claim 1, wherein the calculation control section outputs the valve control signal toward the flow amount control valve with a predetermined change amount per a predetermined unit time, and the calculation control section outputs the pump control signal toward the variable displacement hydraulic pump with a predetermined change amount per a predetermined unit time.

* * * * *